US009685742B2

(12) United States Patent
Liu et al.

(10) Patent No.: US 9,685,742 B2
(45) Date of Patent: Jun. 20, 2017

(54) SURFACE CONTACT PLUG AND SOCKET

(71) Applicant: FIRST ELECTRIC ING. CHONGQING, Chongqing (CN)

(72) Inventors: Shuo Liu, Chongqing (CN); Zhongxian Liu, Chongqing (CN); Zhongyu Liu, Chongqing (CN)

(73) Assignee: FIRST ELECTRIC ING. CHONGQING, Chongqing (CN)

( * ) Notice: Subject to any disclaimer, the term of this patent is extended or adjusted under 35 U.S.C. 154(b) by 91 days.

(21) Appl. No.: 14/648,691

(22) PCT Filed: Nov. 28, 2013

(86) PCT No.: PCT/CN2013/088015
§ 371 (c)(1),
(2) Date: May 29, 2015

(87) PCT Pub. No.: WO2014/082582
PCT Pub. Date: Jun. 5, 2014

(65) Prior Publication Data

US 2015/0333457 A1 Nov. 19, 2015

(30) Foreign Application Priority Data

Nov. 30, 2012 (CN) ..... 2012 1 0502870

(51) Int. Cl.
*H01R 13/713* (2006.01)
*H01H 37/00* (2006.01)
(Continued)

(52) U.S. Cl.
CPC ..... *H01R 13/713* (2013.01); *H01H 13/14* (2013.01); *H01H 36/0013* (2013.01);
(Continued)

(58) Field of Classification Search
USPC ..... 439/620.08, 320, 668, 17, 39
See application file for complete search history.

(56) References Cited

U.S. PATENT DOCUMENTS 2,749,526 A * 6/1956 Petersen ..... H01R 13/22 29/881
3,193,636 A * 7/1965 Daniels ..... H01R 24/58 191/12 R (Continued)

FOREIGN PATENT DOCUMENTS

CN 2509749 Y 9/2002
CN 203225404 U 10/2013
EP 0561053 A1 9/1993

*Primary Examiner* — Alexander Gilman
(74) *Attorney, Agent, or Firm* — Novick, Kim & Lee, PLLC; Allen Xue

(57) ABSTRACT

The present invention relates to the technical field of plugs and sockets for electrical appliances. Disclosed are a surface contact plug and socket, comprising a matching plug and socket; a plug contact piece connected with a plug electric wire is arranged on the lower surface of the plug; and a socket contact piece connected with a socket electric wire is arranged on the upper surface of the socket; when the plug is inserted into the socket, the plug contact piece vertically or obliquely meets the socket contact piece to cause surface contact electrification. The surface contact plug and socket of the present invention employ surface contact between contact pieces, enlarge the contact area and improve current transmission capacity since the plug and socket are of the same size, and therefore the contact is always reliable, and the more the plug and the socket are used, the more reliable the contact is.

9 Claims, 16 Drawing Sheets

(51) Int. Cl.

| | |
|---|---|
| ***H01H 13/14*** | (2006.01) |
| ***H01H 37/52*** | (2006.01) |
| ***H01H 36/00*** | (2006.01) |
| ***H01R 13/703*** | (2006.01) |
| *H01R 13/24* | (2006.01) |
| *H01R 13/62* | (2006.01) |
| *H01R 13/627* | (2006.01) |
| *H01R 13/633* | (2006.01) |
| *H01R 13/70* | (2006.01) |
| *H01R 24/38* | (2011.01) |
| *H01R 24/58* | (2011.01) |

(52) U.S. Cl.

CPC ..... *H01H 37/002* (2013.01); *H01H 37/52* (2013.01); *H01R 13/7037* (2013.01); *H01R 13/24* (2013.01); *H01R 13/6205* (2013.01); *H01R 13/6278* (2013.01); *H01R 13/633* (2013.01); *H01R 13/701* (2013.01); *H01R 13/7031* (2013.01); *H01R 13/7137* (2013.01); *H01R 24/38* (2013.01); *H01R 24/58* (2013.01)

(56) References Cited

U.S. PATENT DOCUMENTS 3,808,577 A * 4/1974 Mathauser ..... H01R 13/6205 439/180
3,810,258 A * 5/1974 Mathauser ..... H01R 13/6205 439/246
4,025,964 A * 5/1977 Owens ..... A61M 39/0247 128/899
4,346,419 A * 8/1982 Janniello ..... H01R 13/7038 200/51.09
4,640,570 A * 2/1987 Strate ..... H01R 13/631 439/271
5,048,914 A * 9/1991 Sneddon ..... H01R 13/7038 385/24
5,409,403 A * 4/1995 Falossi ..... H01R 24/38 439/21
5,580,261 A * 12/1996 Meynier ..... H01R 24/46 439/188
5,949,160 A * 9/1999 Anderson ..... H02J 7/0031 200/51.09
5,984,687 A * 11/1999 Schwarz ..... H01R 39/643 439/17
6,192,435 B1 * 2/2001 Takahashi ..... G06F 13/4081 361/58
6,379,191 B1 * 4/2002 Goetz ..... H01R 25/003 362/249.01
6,439,932 B1 * 8/2002 Ripolone ..... E21B 17/028 439/668
6,554,490 B1 * 4/2003 Sumi ..... G02B 6/4292 385/139
6,988,915 B2 * 1/2006 Hirose ..... H01R 4/68 439/108
7,056,127 B2 * 6/2006 Suzuki ..... H01R 13/6205 439/22
7,395,166 B2 * 7/2008 Plishner ..... A61N 1/025 257/E23.01
7,462,957 B2 * 12/2008 Camwell ..... H01R 13/7035 307/131
8,821,194 B2 * 9/2014 Shih ..... H01R 24/58 439/668
9,093,781 B2 * 7/2015 Liu ..... H01R 13/6205
9,203,184 B1 * 12/2015 Hui ..... H01R 13/629

* cited by examiner

SURFACE CONTACT PLUG AND SOCKET

FIELD OF THE INVENTION

The invention relates to the technical field of plugs and sockets for electric appliances, in particular to a plug and a socket which can rotate relatively.

DESCRIPTION OF THE RELATED ART

The current transmission capacity of a plug and a socket is closely related to contact resistance R between plug and socket contact pieces. If the contact resistance R at the plug and socket contact pieces is large, energy will be consumed when high current passes by, heating the contact surface of the plug and the socket, or damaging the plug, the socket, wires and supporting facilities thereof, and even causing a fire in some severe cases. In addition, the electric appliance will also work abnormally due to insufficient power supply, or be damaged in some severe cases. The value of the contact resistance R is closely related to contact area S of the plug and socket contact pieces and pressure P, the larger the contact area S is, the higher the pressure P is, and the smaller the contact resistance R is.

The contact resistance R of the plug and the socket of the prior art depends on the surface flatness and smoothness of plug contact pieces 1, and the surface flatness, smoothness and parallelism of socket contact pieces 2. In addition, the contact resistance R also depends on materials, heat treatment process, riveting process and assembly process of the plug contact pieces 1 and socket contact pieces 2 as well as influences of mechanical wear, distortion, degree of fatigue, heat and humidity in use.

A plug and a socket under ideal conditions are shown in FIG. 1, the plug contact pieces 1 of the plug are perpendicular to a plug panel, and inserted into the socket contact pieces 2 of the socket. Two side walls of the quadrate plug contact pieces 1 can be in full fit with contact parts 2*b* of the socket contact pieces 2 to keep the plug contact pieces 1 and the socket contact pieces 2 in surface contact, ensuring the current transmission effect. For the plug and the socket under ideal conditions, the plug contact pieces 1 are smoothly inserted into the socket contact pieces 2 under the action of guide parts 2*a*, and the parts that really plays a role in current transmission between the plug and the socket are the contact parts 2*b* between side walls of the plug contact pieces 1 and the socket contact pieces 2. Therefore, to ensure the plug and the socket under ideal conditions, the socket contact pieces 2 need to have high elasticity to allow the contact parts 2*b* to adhere closely to the side walls of the plug contact pieces 1 so as to maintain current transmission performance. Thus, the socket contact pieces 2 need to have high current transmission performance and high elasticity at the contact parts 2*b*. Otherwise, the service life or current transmission performance of the socket contact pieces 2 will be greatly reduced. As a result, high-performance expensive alloy copper has to be used as materials (e.g., tin-phosphor bronze and beryllium bronze) of the socket contact pieces 2. However, as fixing parts 2*c* of the socket contact pieces 2 are only used for fixing and electric conduction, expensive alloy copper materials are not required, resulting in too much waste of precious metals, and increasing the cost.

For the plug and the socket of the prior art, due to design of the contact parts 2*b* on the socket contact pieces 2, a structure shown in FIG. 2 is formed to ensure good elasticity of the socket contact pieces 2. Line contact is formed when the contact parts 2*b* on the socket contact pieces 2 are in contact with two sides of the plug contact pieces 1, so that the contact area S is small, the contact resistance R is large, and the current transmission capacity is influenced, affecting normal operation of electrical appliances. The contact area S between the plug contact pieces 1 and the socket contact pieces 2 is greatly reduced due to manufacturing process, material, wear, mechanical distortion, environment, heat and looseness of the socket contact pieces 2, resulting in poor contact, and reducing the current transmission capacity. Due to distortion of the socket contact pieces 2 in the long-term use, the plug contact pieces 1 can only be in contact with the socket contact piece 2 on one side of the socket.

Although surface contact can be still maintained, the contact area S is reduced by half relatively, resulting in poor contact, and affecting normal operation of the electrical appliances. During use, the plug contact pieces 1 can be obliquely inserted into the socket, causing mechanical distortion. The plug contact pieces 1 are oblique between two socket contact pieces 2, so that two sides of the plug contact pieces 1 are in line contact with the two socket contact pieces 2 respectively, and the contact area S is greatly reduced compared with that under ideal conditions, reducing the current transmission capacity. To overcome defects in FIG. 2, for a plug and socket of the prior design, the plug contact pieces 1 are of cylindrical shape, and the two socket contact pieces 2 are of conical shape. When the plug contact pieces 1 are inserted into the two socket contact pieces 2, the plug contact pieces 1 are distorted, so that the plug contact pieces 1 are in fit with one socket contact piece 2 to form line contact, and in point contact with the other socket contact piece 2. Such structure can improve structural defects in FIG. 1, but the contact area S is still greatly reduced compared with the plug and the socket under ideal conditions, affecting the current transmission capacity.

In addition, during use of the plug and the socket of the prior art, a contact form between the plug contact pieces 1 and the socket contact pieces 2 is shown in FIG. 1. In the contact form, the contact area S is greatly reduced compared with the contact area S under ideal conditions. Without consideration of materials, environment, flatness and smoothness of the contact pieces, the current transmission capacity in the contact form is greatly reduced compared with that under ideal conditions, thus affecting normal operation of the electrical appliances. A universal socket widely used at present is shown in FIG. 3, the contact area S of the plug contact pieces 1 and the socket contact pieces 2 is a line, or even multiple points. Therefore, slightly large passing current will cause heat and ablation, and even fire.

To adapt to round head plugs and flat head plugs, recesses are designed in the middle of some sockets.

Although the sockets are adapted to two kinds of plugs, the plugs and the sockets are in line contact, reducing the contact area of the plugs and sockets, and resulting in hidden dangers. Besides the characteristics, the plug and the socket of the prior art also have the following defects:

1. To accurately align the plug and the socket of the prior art, the plug contact pieces 1 are required to be perpendicular to the socket panel so as to be inserted into the socket contact pieces 2. In addition, as the socket contact pieces 2 need to have high elasticity to clamp the plug contact pieces 1, insertion and unplugging need great effort.
2. As two sides of the plug contact pieces 1 are required to be in contact with the socket contact pieces 2 for current transmission, the two sides of the plug contact pieces 1 are live in current transmission. When the plug is inserted or unplugged to a certain position, part of the sides of the plug contact pieces 1 is exposed on the surface of the socket, and fingers will get an electric shock in case of contact with conductive copper sheets, thus the safety is low.

3. As the wires of the plug and socket are fixed on the plug, and the plug and the socket can not rotate relatively, the direction of the wires on the plug remains unchanged. Moreover, as the socket is generally fixed, when the plug and the socket are not aligned during use and the wires are to be rotated, the wires are distorted and then the plug is inserted into the socket. After doing so for a long term, the joint of the wires and the plug will be damaged, and the circuit will be exposed, resulting in dangers, and the safety is low. A plug and a socket which can rotate relatively are provided in the prior art, such as a plug and a socket for an electric heater kettle, as shown in FIG. 3. The principle used is to closely attach an elastic contact head 3 to an outer wall of a contact ring 4. The contact head 3 and the contact ring 4 are in point contact or line contact, but the contact area S is still small, and the effective current transmission capacity is low. Meanwhile, the contact head 3 needs to have high elasticity, thus expensive nonferrous materials have to be used, increasing the production cost.
4. The contact area between the plug contact pieces and the socket contact pieces is limited. The length or width of the contact pieces is increased to achieve the same current transmission, increasing the contact area S, resulting in waste of nonferrous materials, and increasing the cost.
5. For a socket of the prior art, if someone (especially a child) inserts metals into socket holes, electric shock easily occurs. Some wall sockets are provided with a cover plate at plug holes, so that the plug cannot be inserted into existing single hole, but can be inserted into two holes, resulting in electric shock. In addition, after the cover plate is provided, a great effort is needed to insert the plug into the socket, thus bringing inconvenient to use of the socket.
6. In addition, as the socket of the prior art is not provided with an overcurrent protection mechanism, overcurrent protection capability is unavailable in case of excessive current, heating the contact surface, or damaging the plug and the socket, and even causing a fire in some severe cases. Moreover, short circuit easily occurs to the socket in high temperature environment, resulting in extremely low safety performance in use.

To sum up, the plug and the socket of the prior art may be worn and deformed with the increased frequency of insertion and unplugging of the plug and the socket, thus resulting in poor contact more easily.

SUMMARY OF THE INVENTION

To address the problems, the purpose of the invention is to provide a plug and a socket in surface contact characterized by simple structure and easy operation to keep contact pieces in surface contact, so that the contact area is increased, the current transmission capacity is increased, the contact is permanently reliable, and the more frequent the plug and the socket are used, the more reliable the contact is in case of the same volume of the plug and the socket. A contact electrode is designed into a block or circular shape, so that the plug can rotate on the socket, thus the plug can rotate freely without distorting wires, improving the service performance. In addition, the contact pieces are made of a copper material with low cost and good conductivity, reducing the material used and reducing the cost. Furthermore, a safety protection mechanism is arranged in the socket, thus the plug and the socket are absolutely deenergized when hands can touch the contact electrode, and can be energized only when hands cannot touch the contact electrode completely. Therefore, the plug and the socket are very safe for use. Even if metals are inserted into the socket contact pieces, short circuit or electric shock will not occur. Moreover, an overcurrent protection mechanism is arranged in the socket for overcurrent protection, thus effectively avoiding burning out the socket or even fire due to heat in overcurrent transmission.

The technical solution of the invention is as follows:

The plug and socket in surface contact of the invention comprises a plug and a socket which are matched with each other. Plug contact pieces connected with plug wires are arranged on the lower surface of the plug, and socket contact pieces connected with socket wires are arranged on the upper surface of the socket; when the plug is inserted into the socket, the plug contact pieces vertically and/or obliquely meet the socket contact pieces to cause surface contact energization.

With the structure, the sheet plug contact pieces are arranged on the lower surface of the plug according to the shape and structure of the plug, and the sheet socket contact pieces connected with the socket wires are arranged on the upper surface of the socket. The plug can match the shape and structure of the socket in use. In such case, the faces of the plug contact pieces can be in fit with those of the socket contact pieces, allowing the invention to be different from the prior art. The plug contact pieces and the socket contact pieces can be in surface contact, including various surface contact forms such as plane contact, oblique surface contact, curved surface contact and irregular surface contact, thus greatly increasing the contact area of the plug and socket contact pieces in the plug and the socket, and increasing the current transmission capacity. As the contact pieces are in surface contact in a vertical direction and an oblique direction (the vertical direction refers to the central axial direction of the plug and the socket when the plug is placed opposite to the socket, and the oblique direction is relative to the vertical direction), the contact pieces will be maintained in surface contact without deformation in case of wear due to use of the contact pieces for a long term, instead, the contact surface is in closer contact. The more frequent the plug and the socket are used, the more reliable the contact is. The invention can effectively solve adverse effects resulting from poor contact of the contact pieces in the prior art. The contact pieces only need to have good conductivity, without need for elasticity. Therefore, a copper material with low cost and good conductivity can be used, reducing the material used and reducing the cost.

The plug and socket in surface contact of the invention is characterized in that a socket recess is arranged on the socket, the lower part of the plug and the cavity of the socket recess are a boss and a recess with large upper parts and small lower parts which are matched with each other respectively, the plug contact pieces are arranged on the boss surface of the plug and/or the sloping side wall of the boss, and the socket contact pieces are arranged on the inner cone surface and/or the inner sloping side wall of the socket recess.

With the structure, the socket recess can be arranged on the socket for insertion of the plug, allowing the plug and the socket to be matched with each other. The socket contact pieces are arranged on the inner bottom surface and/or the inner sloping side wall of the socket recess of the socket. The plug and the socket can be matched with each other. When the plug is inserted into the socket recess of the socket, the plug contact pieces can be in fit with the socket contact pieces. However, different from contact forms of contact pieces of the prior art, the plug contact pieces vertically and/or obliquely meet the socket contact pieces to form surface contact between the plug contact pieces and the socket contact pieces, thus being able to effectively increase the contact area of contact pieces, and increasing the current transmission capacity. Due to surface contact of the contact pieces in the vertical direction and the oblique direction, the contact pieces will be maintained in surface contact without deformation in case of wear due to use of the contact pieces for a long term, instead, the contact surface is in closer contact. The more frequent the plug and the socket are used, the more reliable the contact is. Thus the invention can effectively solve adverse effects resulting from poor contact of the contact pieces in the prior art. The contact pieces only need to have good conductivity, with no need for elasticity. Therefore, a copper material with low cost and good conductivity can be used, reducing the material used and reducing the cost. The lower part of the plug is a boss with a large upper part and a small lower part, and the cavity of the socket recess is a recess with a large upper part and a small lower part. The lower part of the plug and the socket recess are matched with each other, and the plug contact pieces are arranged on the boss surface of the lower part of the plug and/or the sloping side wall of the boss, and the arrangement positions depend on actual needs. Similarly, the socket contact pieces are arranged on the inner cone surface and/or the inner sloping side wall of the socket recess. When the plug is inserted into the socket, the plug contact pieces on the boss surface of the lower part of the plug are in fit with the socket contact pieces on the inner cone surface of the socket recess in the vertical direction (i.e., the axial direction of the centerline of the plug and the socket), and the plug contact pieces on the sloping side wall of the boss of the lower part of the plug are in fit with the socket contact pieces on the inner sloping side wall of the socket recess in the oblique direction, so that the contact area is greatly increased, the current transmission capacity is increased, the contact is permanently reliable, and the more frequent the plug and the socket are used, the more reliable the contact is in case of the same volume of the plug and the socket.

The plug and socket in surface contact of the invention is characterized in that the lower part of the plug and the cavity of the socket recess are inverted cone, inverted cone frustum, inverted stepped truncated cone or inverted stepped cone frustum. The plug contact pieces are uniformly arranged on the lower cone surface of the plug or the lower cone surface and/or the cone in the form of concentric rings, and the socket contact pieces are uniformly arranged on the lower cone surface of the socket or the inner cone surface and/or inner cone of the socket recess in the form of concentric rings.

With the structure, the lower part of the plug and the cavity of the socket recess can be in multiple structural forms such as inverted cone, inverted cone frustum, inverted stepped truncated cone or inverted stepped cone frustum with large upper parts and small lower parts. Other structures with large upper parts and small lower parts can be arranged according to actual needs. The plug contact pieces can be in any structure or arrangement according to the actual structural shape of the plug. For example, sheet plug contact pieces of any geometric shapes can be uniformly arranged on the same ring on the lower bottom of the plug in the form of circular pieces, or circular sheet plug contact pieces can be arranged on the lower cone surface and/or the cone of the plug in the form of concentric rings. Accordingly, the socket contact pieces can be in any structure or arrangement according to the actual structural shape of the plug. For example, sheet socket contact pieces of any geometric shapes can be uniformly arranged on the same ring on the inner bottom of the socket recess in the form of circular pieces, or circular sheet socket contact pieces can be arranged on the inner cone surface and/or inner cone of the socket recess in the form of concentric rings. For the plug and socket in surface contact of the invention, the plug and the socket have various shapes and structures, and wide scope of application, and can be chosen at will according to needs. The contact electrode is designed into a circular block or circular structure, so that the plug can rotate on the socket, thus the plug can rotate at any angle for convenient use without distorting the wires, improving the service performance. In addition, the contact pieces are made of a copper material with low cost and good conductivity, reducing the material used and reducing the cost.

The plug and socket in surface contact of the invention is characterized in that the plug and/or the socket are/is provided with a locating fixing mechanism, an overcurrent protection mechanism and/or a power supply safety switch; the plug and the socket can relatively rotate without disconnection by the locating fixing mechanism to keep surface contact between the plug contact pieces and the socket contact pieces; the overcurrent protection mechanism automatically deenergizes in case of excessive current in the plug and the socket; and when the plug is inserted into the socket, the power supply safety switch energizes the socket, and when the plug is not inserted into the socket or is not inserted in place, the power supply safety switch deenergizes the socket.

With the structure, the plug and/or the socket are/is provided with the locating fixing mechanism, the overcurrent protection mechanism and/or the power supply safety switch depending on needs. In addition, the locating fixing mechanism, the overcurrent protection mechanism and/or the power supply safety switch can be arranged in the plug and the socket alternatively or in any combination, such as combination of the locating fixing mechanism and the overcurrent protection mechanism, combination of the locating fixing mechanism and the power supply safety switch, and combination of the locating fixing mechanism, the overcurrent protection mechanism and the power supply safety switch. The locating fixing mechanism can locate and fix the plug inserted into the socket, so that the plug and the socket can relatively rotate without disconnection to keep surface contact between the plug contact pieces and the socket contact pieces with no influence on transmission of large current. As a result, the plug can rotate on the socket, thus the plug can rotate at any angle for convenient use without distorting the wires, improving the service performance. The overcurrent protection mechanism is mainly used to protect use safety of the plug and the socket, and automatically deenergizes in case of excessive current in the plug and the socket for overcurrent protection, thus effectively avoiding burning out the socket or even fire due to heat in overcurrent transmission. When the plug is inserted into the socket, the power supply safety switch energizes the socket, and when the plug is not inserted into the socket or is not inserted in place, the power supply safety switch deenergizes the socket. Thus the plug and the socket are absolutely deenergized when hands can contact the contact electrode, and can be energized only when hands cannot contact the contact electrode completely. Therefore, the plug and the socket are very safe for use. Even if metal is inserted into the socket contact pieces, short circuit or electric shock will not occur.

The plug and socket in surface contact of the invention is characterized in that power switch moving contacts and power switch fixed contacts are arranged in the socket, the power switch moving contacts are connected onto the socket contact pieces or the socket wires, and the power switch fixed contacts are correspondingly connected onto the socket wires or the socket contact pieces; the power supply safety switch drives the power switch moving contacts to move under the action of a push-and-move key, so that the power supply safety switch is connected with or disconnected from the power switch fixed contacts for energization or deenergization; and the overcurrent protection mechanism disconnects the power switch moving contacts from the power switch fixed contacts for deenergization in case of excessive current in the plug and the socket.

With the structure, the power switch moving contacts and the power switch fixed contacts are arranged in the socket, and can be connected onto the socket wires of the socket contact pieces respectively, i.e., when the power switch moving contacts are connected onto the socket wires, the power switch fixed contacts are connected onto the socket contact pieces; and when the power switch moving contacts are connected onto the socket contact pieces, the power switch fixed contacts are connected onto the socket wires depending on actual needs. The power supply safety switch is mainly used to touch the push-and-move key to drive the power switch moving contacts to move when the plug is inserted into the socket, and connect or disconnect the power switch moving contacts with or from the power switch fixed contacts for energization or deenergization. The overcurrent protection mechanism is mainly used to disconnect the power switch moving contacts from the power switch fixed contacts for deenergization in case of excessive current in the plug and the socket.

For the plug and socket in surface contact of the invention, the push-and-move key is set to be an elastic sheet, the elastic sheet is connected onto the socket by an elastic sheet spring, the power switch moving contacts are arranged on the end of the elastic sheet or in the moving direction of the elastic sheet, the power switch fixed contacts are arranged in the moving direction of the power switch moving contacts, the elastic sheet drives the power switch moving contacts to move under the action of a control key, so that the power switch moving contacts are connected with or disconnected from the power switch fixed contacts for energization or deenergization; or the push-and-move key is a clip key arranged on the plug and a buckling key arranged on the power switch moving contacts, the ends of the power switch moving contacts are moved when the clip key moves in and out of the buckling key, so that the power switch moving contacts are connected with or disconnected from the power switch fixed contacts for energization or deenergization.

With the structure, the push-and-move key capable of moving the power switch moving contacts of the power supply safety switch can be the elastic sheet arranged in the socket or the clip key arranged on the matching plug or the buckle arranged on the power switch moving contact. When the push-and-move key is an elastic sheet, the elastic sheet is connected onto the base or the side wall of the socket by the elastic sheet spring. The power switch moving contacts are arranged on the ends of the elastic sheet, the specific number thereof can be selected and set according to actual demands, and the power switch moving contacts also can be set beside the elastic sheet or connected onto the elastic sheet. The elastic sheet drives the power switch moving contacts to move during moving process thereof, so the elastic sheet can be arranged at any place as long as the elastic sheet drives the power switch moving contacts to move. The power switch fixed contacts are arranged beside the power switch moving contacts, the power switch moving contacts can be connected with or separated from the power switch fixed contacts when the power switch moving contacts move, so that the power switch fixed contacts are arranged in the moving direction of the power switch moving contacts. The movement of the elastic sheet of the invention is controlled by the control key which can be matched with the plug. The control key drives the elastic sheet to move when the plug is inserted into the socket, so that the power switch moving contacts are connected with the power switch fixed contacts for energization. The control key cancels the applied force to the elastic sheet when the plug is unplugged out of the socket, then the elastic sheet is restored to original position thereof under the action of the spring, so that the power switch moving contacts are disconnected from the power switch fixed contacts for deenergization. The control key can effectively control energization and deenergization of the socket, and make operation simple and use convenient and reliable. When the push-and-move key consists of the clip key and a buckle, the clip key is arranged on the plug and the buckling key is arranged on the power switch moving contacts, the clip key and the buckling key can mutually match each other. The plug drives the clip key to be inserted into the buckling key when the plug is inserted into the socket, the clip key drives the ends of two power switch moving contacts to move, and the power switch moving contacts are connected with the power switch fixed contacts for energization; when the plug is unplugged out of the socket, the plug drives the clip key to be unplugged out of the buckling key, the ends of two power switch moving contacts move under the elastic action of the spring, the resilient part or the power switch moving contacts, so that the power switch moving contacts are separated from the power switch fixed contacts for deenergization, thus effectively controlling energization and deenergization of the socket, and making operation simple and use convenient and reliable.

For the plug and socket in surface contact of the invention, the control key is a push-push switch connected onto the elastic sheet and passing through the side wall of the socket; or the control key is a magnet arranged in the plug, the magnet attracts the elastic sheet under the socket recess; or the control key is a plug nose arranged on the bottom of the plug, and the tip of the plug nose passes through a socket through hole on the inner bottom of the socket recess and props against the elastic sheet under the socket through hole.

With the structure, the control key capable of moving the elastic sheet can be a push-and-move switch, a magnet or a plug nose, and the push-and-move switch can be the push-push switch. When an operator pushes the button on the push-push switch, the push-push switch can push the elastic sheet to move while limiting the elastic sheet, so the elastic sheet can stably stay at a certain position, and the power switch moving contacts are connected with the power switch fixed contacts for energization. When the operator pushes the button on the switch again, the switch can push the elastic sheet to move and cancel limitation on the elastic sheet. The elastic sheet is restored to the original position thereof under the action of the elastic sheet spring, and the power switch moving contacts are disconnected from the power switch fixed contacts for deenergization. Such push-push switch can be various types and is also used in other fields including television switch, spring switch of ball pen. In the invention, the switch with such function is used to control the elastic sheet in the socket for the first time, thus controlling energization of the socket and ensuring application safety of the socket. The control key capable of moving the elastic sheet can be a magnet, i.e., the magnet is arranged in the plug, the elastic sheet is located under the socket recess, the elastic sheet can be made of magnet or other materials that can be attracted by the magnetic force of the magnet. When the plug is inserted into the socket recess, the elastic sheet can move upwards under the action of the magnetic force of the elastic sheet to drive the power switch moving contacts to be connected with the power switch fixed contacts for energization. When the plug is unplugged out of the socket recess, the elastic sheet is not attracted by the magnet any more, so that the elastic sheet can be restored to the original position thereof under the action of the elastic sheet spring, therefore, the power switch moving contacts are driven to be disconnected from the power switch fixed contacts for deenergization. In the invention, the elastic sheet is controlled by the magnetic force to control energization and deenergization of the socket. Similarly, materials other than magnet that can be attracted by the magnetic force of the magnet can be arranged on the plug as required. The control key capable of moving the elastic sheet is the plug nose arranged on the bottom of the plug, the tip of the plug nose can pass through the socket through hole on the inner bottom of the socket recess and props against the elastic sheet under the socket through hole. The elastic sheet is required to be arranged under the socket recess and under the lower part of the through hole. When the plug is inserted into the socket, the tip of the plug nose acts on the elastic sheet to press the elastic sheet downward, so that the elastic sheet drives the power switch moving contacts to be connected with the power switch fixed contacts for energization. When the plug is unplugged out of the socket, pressure of the tip of the plug nose on the elastic sheet disappears, the elastic sheet is restored to the original position thereof under the action of the elastic sheet spring, so that the power switch moving contacts are disconnected from the power switch fixed contacts for deenergization, realizing control over energization of the socket.

For the plug and socket in surface contact of the invention, the overcurrent protection mechanism mainly consists of the power switch moving contacts and/or the power switch fixed contacts made of bimetal sheets, the bimetal sheets comprise a first metal sheet and a second metal sheet with different coefficients of thermal expansion, the expansion quantity of one metal sheet is more than that of the other metal sheet in case of thermal deformation of the bimetal sheets, so that the power switch moving contacts are disconnected from the power switch fixed contacts for deenergization; or the overcurrent protection mechanism mainly consists of the magnet arranged in the plug and/or socket, the magnet loses its magnetic force when the current in the plug and the socket is too high and the temperature of the heat transferred to the magnet reaches the curie point; the elastic sheet under the socket recess is restored to the original position thereof under the action of the elastic sheet spring, so that the power switch moving contacts are disconnected from the power switch fixed contacts for deenergization.

With the structure, the power switch moving contacts and/or the power switch fixed contacts are made of bimetal sheets in the overcurrent protection mechanism. The bimetal sheets comprise a first metal sheet and a second metal sheet with different coefficients of thermal expansion, i.e., the connection parts of the power switch moving contacts and the power switch fixed contacts may heat up in case of excessive passing current, thereby deforming the bimetal sheets due to heat. Two layers of metal sheets expand; the expansion quantity of one metal sheet is more than that of the other metal sheet, i.e., the expansion quantity of the metal sheet facing to the connection side of the power switch moving contacts and the power switch fixed contacts is more than that of the metal sheet on the opposite side, so that the power switch moving contacts are disconnected from the power switch fixed contacts for deenergization, achieving overcurrent protection of the socket and providing the socket with overcurrent protection function, thus effectively avoiding burning out the socket or even fire due to heat in overcurrent transmission. The overcurrent protection mechanism is design based on the principle that the magnet loses magnetic force when the magnetic reaches the Curie point due to. The magnet is arranged in the plug and/or the socket. The contact pieces will heat up in case of excessive current in the plug and the socket, and the heat will be transferred to the magnet to heat up the magnet.

The magnet will lose magnetic force thereof and attractive force for the elastic sheet under the socket recess when the temperature reaches the Curie point. The elastic sheet is restored to the original position thereof under the action of the elastic force of the elastic sheet spring, and the elastic sheet drives the power switch moving contacts to move, so that the power switch moving contacts are disconnected from the power switch fixed contacts for deenergization; and such two overcurrent protection mechanisms can be separately used or simultaneously used according to the actual demands. The overcurrent protection mechanisms also can be based on the principle of the fuse of the prior art, that is, a fuse is arranged on the line of the socket or the plug. The fuse automatically breaks in case of excessive current, thus achieving overcurrent protection. The overcurrent protection mechanisms of the invention can be arranged in the plug or the socket, or separately arranged in the plug and the socket according to actual demands. The overcurrent protection mechanisms can effectively avoid burning out the socket or even causing fire due to heat in overcurrent transmission.

For the plug and socket in surface contact of the invention, the locating fixing mechanism consists of the magnet arranged in the plug and/or the socket so that the plug and the socket can be mutually attracted and can relatively rotate without disconnection; or the locating fixing mechanism consists of the clip key arranged on the plug or the socket and the buckling key correspondingly arranged on the socket or the plug, the clip key is inserted into the buckling key so that the plug and the socket relatively rotate without disconnection; or the locating fixing mechanism is formed by inserting the plug into the socket or inserting the plug out of the socket and relatively rotating the plug and the socket.

With the structure, the locating fixing mechanism can be a magnet so that the plug and the socket can be mutually attracted and cannot be separated; while the plug and the socket can relatively rotate. Therefore, in the invention, the magnet is arranged in the plug and/or socket according to the demands. In addition, the locating fixing mechanism can be mutually matching clip key and buckling key arranged on the plug and the socket so that the plug and the socket can be mutually buckled when the plug is inserted into the socket. As the buckling key only limits the clip key to move longitudinally and transversely, but the clip key and the buckling key can still relatively rotate, the plug and the socket can relatively rotate without disconnection. The buckling key is arranged in the socket when the buckling key is arranged on the plug; and the buckling key is arranged in the plug when the clip key is arranged on the socket, and the clip key and the buckling key can be mutually matched when the plug is inserted into the socket. The clip key and the buckling key have various structures, the plug and the socket can be mutually matched and can relatively rotate, and the design can be carried out according to actual demands. The locating fixing mechanism is formed by inserting the plug into the socket or inserting the plug out of the socket so that the plug and the socket can be mutually fixed and can relatively rotate, and the structure thereof can be selected as required. If a recess is arranged on the socket and a block is arranged on the plug, the block arranged on the plug can be located in the recess when the plug is inserted into the socket, and the plug and the socket can relatively rotate; and the arrangement can be randomly set as required.

For the plug and socket in surface contact of the invention, the clip key is a telescopic and movable clip shaft arranged on the plug, the buckling key is a clamping mechanism arranged under the socket through hole on the inner bottom of the socket recess, the clamping mechanism is composed of shaft head clamp blocks on the power switch moving contacts, the shaft head clamp blocks on two power switch moving contacts can mutually clamp the tip of the clip shaft, the power switch moving contacts are set to be elastic metal sheets or provided with return springs, release clamp blocks are arranged on the power switch moving contacts, a telescopic and movable release pin shaft passing through the socket is arranged above the release clamp blocks; when the tip of the release pin shaft is inserted between two release clamp blocks, ends of the two power switch moving contacts move, so that the power switch moving contacts are disconnected from the power switch fixed contacts for deenergization, and two shaft head clamp blocks release clamping of the tip of the clip shaft.

With the structure, when the locating fixing mechanism comprises the mutually matching clip key and buckling key, the clip key is set to be a clip shaft which is telescopic and movable on the plug; the buckling key is designed to be a clamping mechanism under the socket through hole on the inner bottom of the plug recess, and the plug and the socket are located and fixed in such a manner that the clip shaft is clamped by the clamping mechanism. The clamping mechanism consists of shaft head clamp blocks arranged on the power switch moving contacts, the shaft head clamp blocks on two power switch moving contacts can be mutually matched to clamp the tips of the clip shafts so as to fix the plug and the socket. For resilience of the power switch moving contacts, the power switch moving contacts can be set to be elastic metal sheets, or return springs are arranged on the power switch moving contacts, so that the shaft head clamp blocks always present the trend of closure and control the clip shaft. Therefore, release clamp blocks can be arranged on the power switch moving contacts and be used together with release pin shafts, tips of the release pin shafts can stretch into the place between two release clamp blocks so that the ends of two power switch moving contacts move, the power switch moving contacts are disconnected from the power switch fixed contacts for deenergization; and two shaft head clamp blocks release clamping of the tips of the clip shafts, and the clip shaft can automatically restore to the original position thereof, and the socket releases fixing of the plug. The release pin shafts are arranged above the release clamp blocks and pass through the socket, and the release pin shafts can stretch and move vertically. The release pin shaft can automatically restore to the original position thereof after stretching into the release clamp blocks.

In conclusion, with the technical solution, the advantages of the invention are as follows:

The plug and socket in surface contact have simple structure and easy operation to keep contact pieces in surface contact, so that the contact area is increased, the current transmission capacity is increased, the contact is permanently reliable, and the more frequent the plug and the socket are used, the more reliable the contact is in case of the same volume of the plug and the socket. A contact electrode is designed into a circular block or circular shape, so that the plug can rotate on the socket, thus the plug can rotate freely without distorting wires, improving the service performance. In addition, the contact pieces are made of a copper material with low cost and good conductivity, reducing the material used and reducing the cost. Furthermore, a safety protection mechanism is arranged in the socket, thus the plug and the socket are absolutely deenergized when hands can touch the contact electrode, and can be energized only when hands cannot touch the contact electrode completely. Therefore, the plug and the socket are very safe for use. Even if a metal is inserted into the socket contact pieces, short circuit or electric shock will not occur. Moreover, an overcurrent protection mechanism is arranged in the socket for overcurrent protection, thus effectively avoiding burning out the socket or even fire due to heat in overcurrent transmission.

BRIEF DESCRIPTION OF THE DRAWINGS

The invention will be described in combination with examples and accompanying drawings, in which.

Marks in figures are as follows: 1-plug contact piece, 2-socket contact piece, 2*a*-guide part, 2*b*-contact part, 2*c*-fixing part, 3-contact head, 4-contact ring; 100-plug, 101-lower plug cover, 102-upper plug cover, 103-plug spring, 104-clip shaft, 105-shaft head, 106-third plug contact piece, 107-second plug contact piece, 108-first plug contact piece, 109-permanent magnet, 110-plug wire, 111-upper cover recess, 112-lower cover recess, 113-plug nose, 114-annular groove, 115-convex seat, 116-magnet; 200-socket, 201-lower socket cover, 202-upper socket cover, 203-socket recess, 204-socket through hole, 205-socket wire, 206-third socket contact piece, 207-second socket contact piece, 208-first socket contact piece, 209-power switch moving contact, 210-power switch fixed contact, 211-shaft head clamp block, 212-release pin shaft, 213-release button, 214-release spring, 215-locating sheet, 216-release shaft head, 217-release clamp block, 218-elastic sheet, 219-elastic sheet spring, 220-spring block, 221-drain hole, 222-sliding push-push switch, 223-bistable push-push switch, 224-plastic spring; 300-bimetal sheet, 301-first metal sheet, 302-second metal sheet.

DESCRIPTION OF THE PREFERRED EMBODIMENT

All features or steps in all methods and procedures disclosed in the specification can be combined in any way, except mutually exclusive features and/or steps.

Any feature disclosed in the specification (including any accessory claims, abstract and accompanying drawings) can be replaced with other equivalent or similar features, unless otherwise specified, that is, each feature is only an example of series of equivalent or similar features, unless otherwise specified.

Curie point mentioned in the invention: a magnetized ferromagnetic material is of strong magnetism. However, with temperature rise, thermal motion of the metal lattice is intensified accordingly and the ordered arrangement of magnetic domain and magnetic moment is affected. When the temperature is too high to damage the orderly arrangement of magnetic domain and magnetic moment, the magnetic domain is collapsed, the average magnetic moment becomes zero, and the ferromagnetic material is demagnetized and become a paramagnetic material. A series of ferromagnetic properties (e.g. high permeability, hysteresis loop and magnetostriction) related to the magnetic domain disappear completely, and the permeability of the ferromagnetic material is converted into the permeability of the corresponding paramagnetic material. When the ferromagnetic properties disappear, the corresponding temperature is the Curie point temperature.

Example 1

Figure 1:
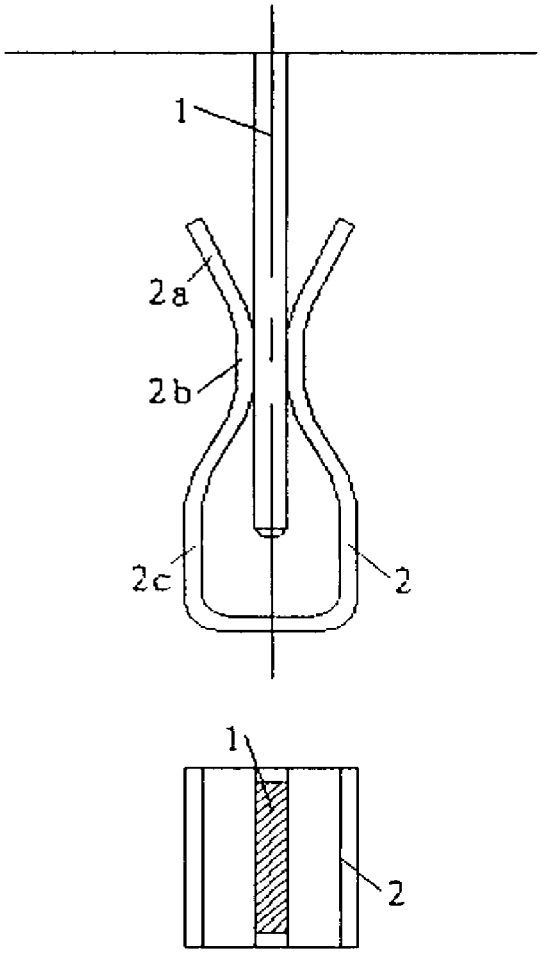
FIG. 1 is a fit diagram of a plug and a socket of the prior art under ideal conditions.
Figure 2:
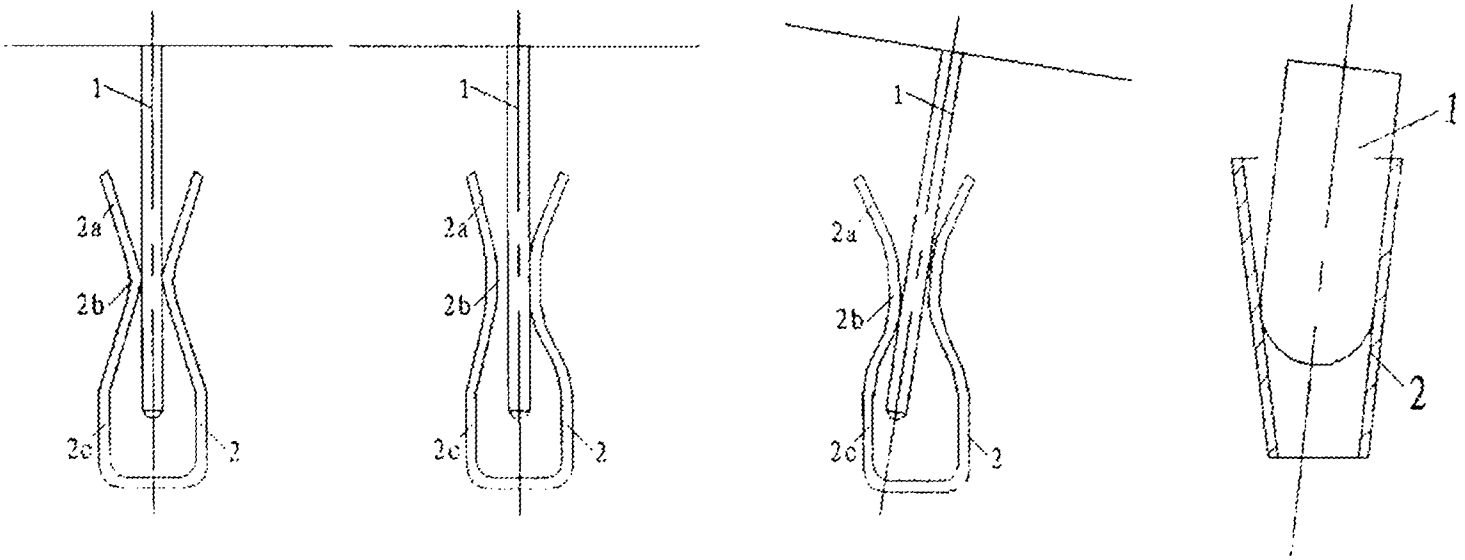
FIG. 2 shows the actual fit between the plug and the socket of the prior art.
Figure 3:
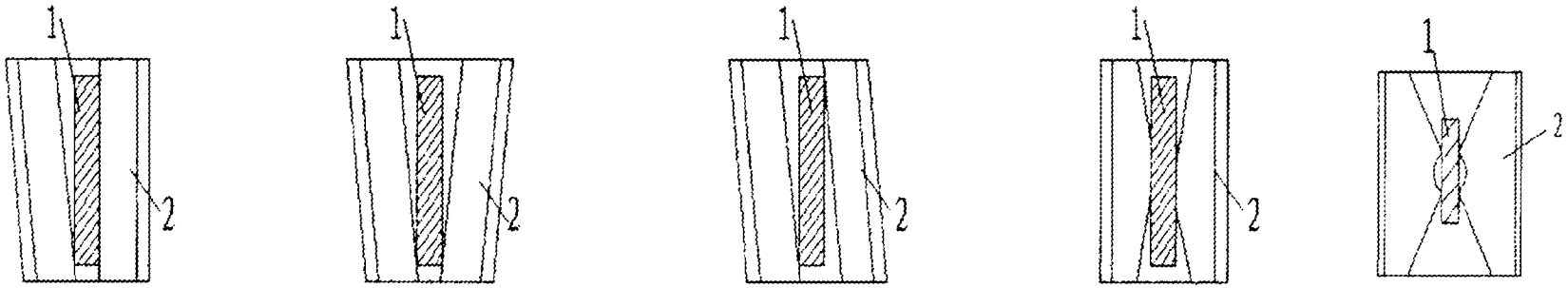
FIG. 3 is an actual sectional view of the actual fit between the plug and the socket of the prior art.
Figure 4:
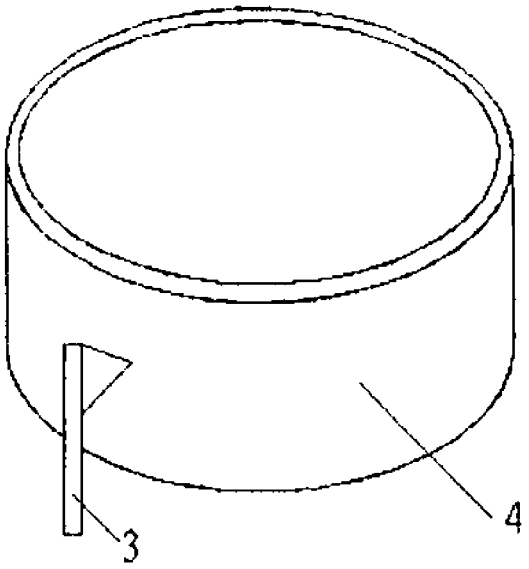
FIG. 4 is another sectional view of the actual fit between the plug and the socket of the prior art.
Figure 5:
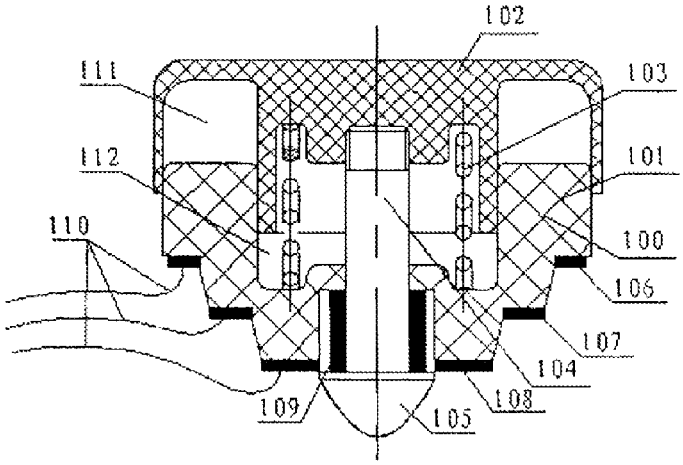
FIG. 5 is a structural diagram of mutually matching plug and socket.
Figure 5:
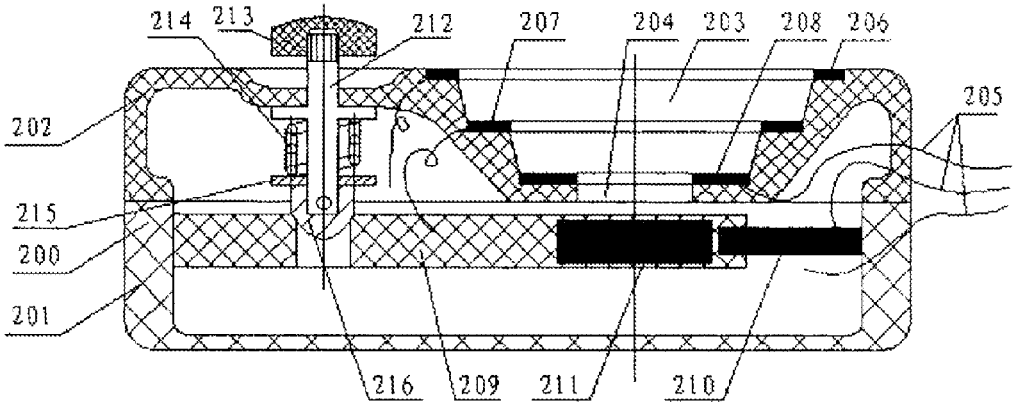

As shown in FIG. 5, the plug 100 of the invention comprises a lower plug cover 101 and an upper plug cover 102, and the upper plug cover 102 is of a circular structure. A bulge is arranged in the middle of the upper plug cover 102, and forms an upper cover recess 111 with the inner wall of the upper plug cover 102. The upper cover recess 111 is of a circular ring or other structures including rectangular ring and elliptical ring according to the structure of the lower plug cover 101 so that the inner wall of the upper plug cover 102 fits with the outer wall of the upper plug cover 102. When the lower plug cover 101 and the upper plug cover 102 move relative to each other, the top of the upper plug cover 102 can move in the upper cover recess 111. The top of the upper plug cover 102 is provided with a concave structure to form the lower cover recess 112. The lower cover recess 112 has the same shape as the bulge in the middle of the upper plug cover 102. The bulge can move relatively in the lower cover recess 112. A clip shaft 104 is connected with the bulge in the middle of the upper plug cover 102 and sheathed with a plug spring 103. The plug spring 103 is limited between the lower plug cover 101 and the upper plug cover 102. The clip shaft 104 stretches to the bottom of the upper plug cover 102 from a through hole at the bottom center of the lower cover recess 112. In addition, the tip of the clip shaft 104 is provided with a shaft head 105, the tip near the clip shaft 104 is sheathed and provided with a permanent magnet 109, and the permanent magnet 109 is sheathed with a protecting jacket. The upper plug cover 102 and lower plug cover 101 move relative to each other. The shaft head 105 on the tip of the clip shaft 104 stretches out of the lower plug cover 101 so as to be fitted and fixed with the lower plug cover 101. When the upper plug cover 102 is free of acting force, the elastic force of the plug spring 103 allows the upper plug cover 102 to moves in the direction away from the lower plug cover 101, the tip of the clip shaft 104 is blocked in the lower plug cover 101 so that the clip shaft 104 and the lower plug cover 101 can not move any more, ensuring reusability. The lower part of the lower plug cover 101 is an inverted circular boss so as to form a multi-step ladder structure, and plug contact piece 1 is respectively arranged on the circular boss surfaces. If three wires are used according to the actual requirements, a three-step boss is selected. The plug contact piece 1 is arranged on three boss surfaces respectively and is connected with plug wires 110 of an electrical appliance. If two wires are used, a two-step boss is selected accordingly, and the plug contact piece 1 is arranged on two boss surfaces respectively. In this way, four-step, five-step or multi-step boss is designed for four wires, five wires or multiple wires accordingly, and the plug contact piece 1 is arranged on each boss surface according to the actual requirements. From the bottom of the plug 100, three plug contact pieces 1 form a concentric ring, the first plug contact piece 108 is located at the innermost ring, the third plug contact piece 106 is located at the outermost ring, and the second plug contact piece 107 is located therebetween. Likewise, the number of the concentric rings can be known from the number of the plug contact pieces 1. The plug contact piece 1 can be made of a material with relative high conductivity and low cost, such as copper.

The socket 200 of the invention comprises a lower socket cover 201 and an upper socket cover 202, the lower socket cover 201 fits with the upper socket cover 202 to constitute a cavity. A downward socket recess 203 is arranged on the top of the upper socket cover 202. The socket recess 203 is an inverted stepped circular boss structure so that the socket recess 203 is a stepped structure. The socket recess 203 can fit with the circular boss on the lower part of the plug 100; socket contact piece 2 is arranged on the boss surfaces on the inner bottom of the socket recess 203 respectively so that the socket contact pieces 2 can constitute concentric rings in the socket recess 203. The number of the socket contact pieces 2 depends on the actually selected two wires, three wires, four wires, five wires or multiple wires and be consistent with the number of the plug contact pieces 1 on the plug 100. The socket contact pieces 2 have the same shape and structure as the plug contact pieces 1. Three wires are used in the example, comprises a first socket contact piece 208 located at the innermost side, a third socket contact piece 206 located at the outermost side and a second socket contact piece 207 located therebetween. If a protection device is not provided, the three socket contact pieces can be connected to the power supply with the socket wires 205. When the plug 100 is inserted in the socket recess 203 of the socket 200, the plug contact pieces 1 fit with the socket contact pieces 2 for energization. When a protection device is required, the energized cable is cut off. However, when three wires are used, a cable is normally used as the ground wire and can be connected with the socket wire 205 directly and the other two cables are connected to two power switch moving contacts 209 respectively. The ends of the two power switch moving contacts 209 are fixed on the inner wall of the lower socket cover 201 respectively; the power switch moving contacts 209 can be made of elastic materials and connected to the inner wall of the lower cover 201 with springs so that two power switch moving contacts 209 always keep the trend of closing inwards or opening outwards, and the other end of the power switch moving contact 209 can be connected with power switch fixed contacts 210 for energization, the power switch fixed contacts 210 are fixed on the inner wall of the lower cover 201 and connected with the power supply with the socket wires 205; shaft head clamp blocks 211 are arranged at the ends of the power switch moving contacts 209 adjacent to the power switch fixed contact 210. The shaft head clamp blocks 211 on two power supply moving contacts 209 can fit with each other to clamp the clip shaft 104, and the shaft head clamp blocks 211 can be attracted by the permanent magnet 10 on the tip of the clip shaft 104 so that the shaft head 105 is limited, the clip shaft 10 can be fixed and the plug 100 can be limited in the socket 200. Therefore, the shaft head clamp block 211 is located under the socket through hole 204 on the bottom of the socket recess 203. The shaft head 105 of the clip shaft 10 can pass through the socket through hole 204 and prop against the lower surface of the shaft head clamp block 211. The shaft head clamp block 211 can clamp the rear end of the shaft head 105 and is attracted by the permanent magnet 109 to stop the clip shaft 10 from moving. Release clamp blocks 217 are arranged on the ends of the power switch moving contacts 209 away from the power switch fixed contacts 210. The release clamp blocks 217 on two power switch moving contacts 209 can fit with each other to clamp the tip of the release pin shaft 212, the release pin shaft 212 passes through the upper socket cover 202 and can move relative to the upper socket cover 202. The tip of the release pin shaft 212 is provided with a release shaft head 216 which is of semicircular bullet structure, conical structure or other structure so that the release shaft head 216 can stretch into the hole between two release clamp blocks 217. When the release pin shaft 212 moves downwards, the release shaft head 216 can be inserted between two release clamp blocks 217 to separate them, and the two power switch moving contacts 209 can be distantly separated. A release spring 214 is sheathed on the release shaft head 216, and the release pin shaft 212 on the rear end of the release shaft head 216 is provided with the locating sheet 215. The locating sheet 215 limits the release spring 214 to the inner top of the upper socket cover 202. A release button 213 is also arranged on the top of the release pin shaft 212 to simplify operation.

Figure 6:
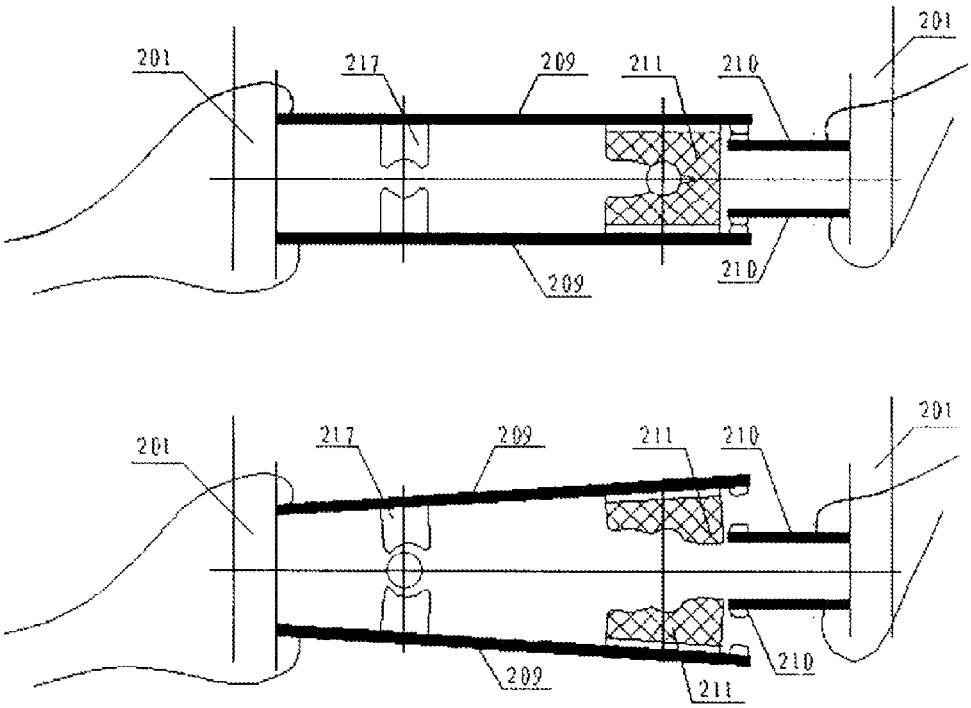
FIG. 6 is a structural diagram of the power switch of the invention in close position and in open position.

As shown in FIG. 6, when the plug and the socket of the invention are used, the lower bottom of the plug 100 is aligned with and inserted into the socket recess 203. At the moment, the top of the upper socket cover 202 is subject to the acting force, the upper socket cover 202 compresses the plug spring 103; the lower end of the clip shaft 104 is inserted into the socket through hole 204 in the inner bottom of the socket recess 203, and the clamped shaft head 105 on the lower end of the clip shaft 104 stretches below the shaft head clamp block 211. Meanwhile, two shaft head clamp blocks 211 are clamped on the clip shaft 104 and are attracted by the permanent magnet. Two shaft head clamp blocks 211 are be closed under the elastic action of the power switch moving contacts 209, and the plug contact pieces 1 are fitted with the socket contact pieces 2 and compressed between the lower part of the plug 100 and the socket recess 203. The power switch moving contacts 209 are connected with the power switch fixed contacts 210 for energization. Meanwhile, the plug 100 and socket 200 can not move relative to each other, and the plug 100 can not be disconnected from the socket 200 to avoid such accidents as electric shock in manual operation and ensure application safety. When the plug 100 is required to be unplugged out of the socket 200, the force acts on the release button 213. At the moment, the release spring 214 is compressed by the shoulder of the release pin shaft 212, the release shaft head 216 at the end of the release pin shaft 212 is inserted between the two release clamp blocks 217, and the locating sheet 215 is attached to the upper surfaces of the two release clamp blocks 217 for location, and the diameter of the release shaft head 216 is larger than that of the hole between the two release clamp blocks 217. Therefore, when the release shaft head 216 is inserted into the hole between the two release clamp blocks 217, the release shaft head 216 can separate the release clamp blocks 217 to the sides so that the ends of the two power switch moving contacts 209 are separated from the power switch fixed contacts 210 respectively, and the plug 100 is deenergized. In this case, the shaft head clamp blocks 211 on the two power switch moving contacts 209 are separated and the acting force on the clip shaft 104 disappears. Meanwhile, under the elastic action of the plug spring 103, the clip shaft 104 and the upper socket cover 202 move relative to the lower plug cover 101 together, the shaft head 105 at the lower end of the clip shaft 104 is quickly retracted from the two release clamp blocks 217, the plug 100 is free of limitation of the socket 200 and can be unplugged out of the socket 200 to release the clip shaft 104. After the plug 100 is unplugged out of the socket 200, the force acting on the release button 213 is cancelled. Under the elastic action of the release spring 214, the release pin shaft 212 and the release shaft head 216 are restored to the original position. For the plug and the socket of the invention, when debris exists on the inner bottom of the socket recess 203, the lower part of the plug 100 cannot be aligned with the inner bottom of the socket recess 203. In this case, the clip shaft 104 is inclined and the rear end face of the shaft head 105 at the end of the clip shaft 104 cannot move to the lower surfaces of the shaft head clamp block 211. Therefore, the plug 100 cannot be locked, the plug contact pieces cannot completely fit with the socket contact pieces, and the power switch moving contacts 209 cannot be connected with the power switch fixed contacts 210 for energization, ensuring the safe use. The plug and the socket of the invention are characterized by simple structure and easy operation, and use the contact pieces in plane contact, so that the contact area is increased, the current transmission capacity is increased, the contact is permanently reliable, and the more frequent the plug and the socket are used, the more reliable the contact is in case of the same volume of the plug and the socket. A contact electrode is made to be a circular structure, so that the plug can rotate at any angle on the socket at convenience of use, without causing arbitrary distortion to wires, improving application performance. In addition, the contact pieces are made of a copper material with low cost and good conductivity, reducing the material used and reducing the cost. Furthermore, a safety protection mechanism is arranged in the socket, thus the plug and the socket are absolutely deenergized when hands can touch the contact electrode, and can be energized only when hands cannot touch the contact electrode completely. Therefore, the plug and the socket are very safe for use.

Example 2

Figure 8:
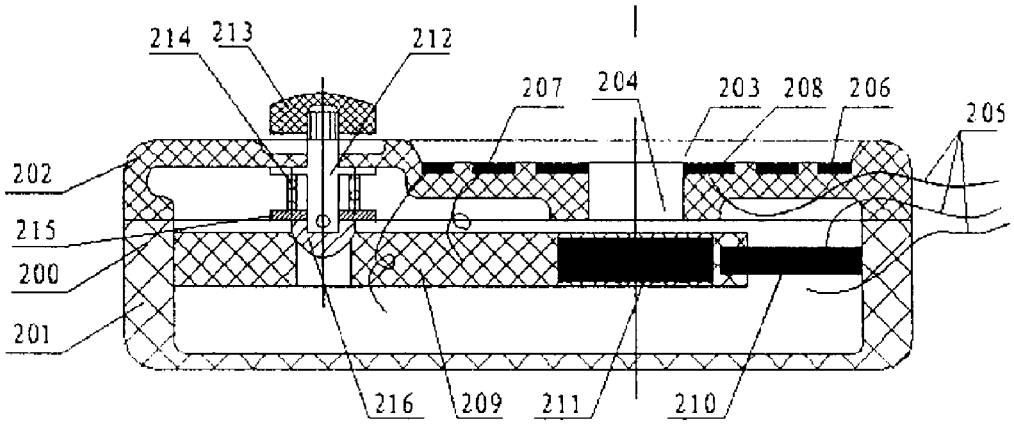
FIG. 8 is another structural diagram of the mutually matching plug and socket.

As shown in FIG. 8, the example is similar to example 1, and the difference lies in that as the lower part of the lower plug cover 101 is a plane, the plug contact piece 1 is arranged on the bottom surface of the lower plug cover 101. When three wires are used, three plug contact pieces 1 form a concentric ring structure with the lower plug cover 101 as the center. The first plug contract piece 108 is located at the innermost circle of the concentric ring, the third plug contract piece 106 is located at the outermost circle of the concentric ring, and the second plug contract piece 107 is located at the middle circle of the concentric ring. The bottom center of the lower plug cover 101 is a through hole for the clip shaft 104 to stretch out and retract. The inner bottom of the socket recess 203 is a flat bottom recess with a socket through hole 204 at middle. The flat bottom recess is able to fit with the bottom surface of the lower plug cover 101. The socket contact pieces 2 are arranged on the inner bottom of the socket recess 203 and form a concentric ring structure with the socket recess 203 as the center. The socket contact pieces 2 are identical with the plug contract pieces 1 in terms of number, shape and structure. When three wires are used, the socket contact pieces 2 consist of a first socket contact piece 208 located at the innermost side, a third socket contact piece 206 located at the outermost side and a second socket contact piece 207 located at the middle layer. When the plug 100 is inserted into the socket 200, three plug contact pieces 1 can fit with three socket contact pieces 2 respectively for power transmission.

Example 3

Figure 10:
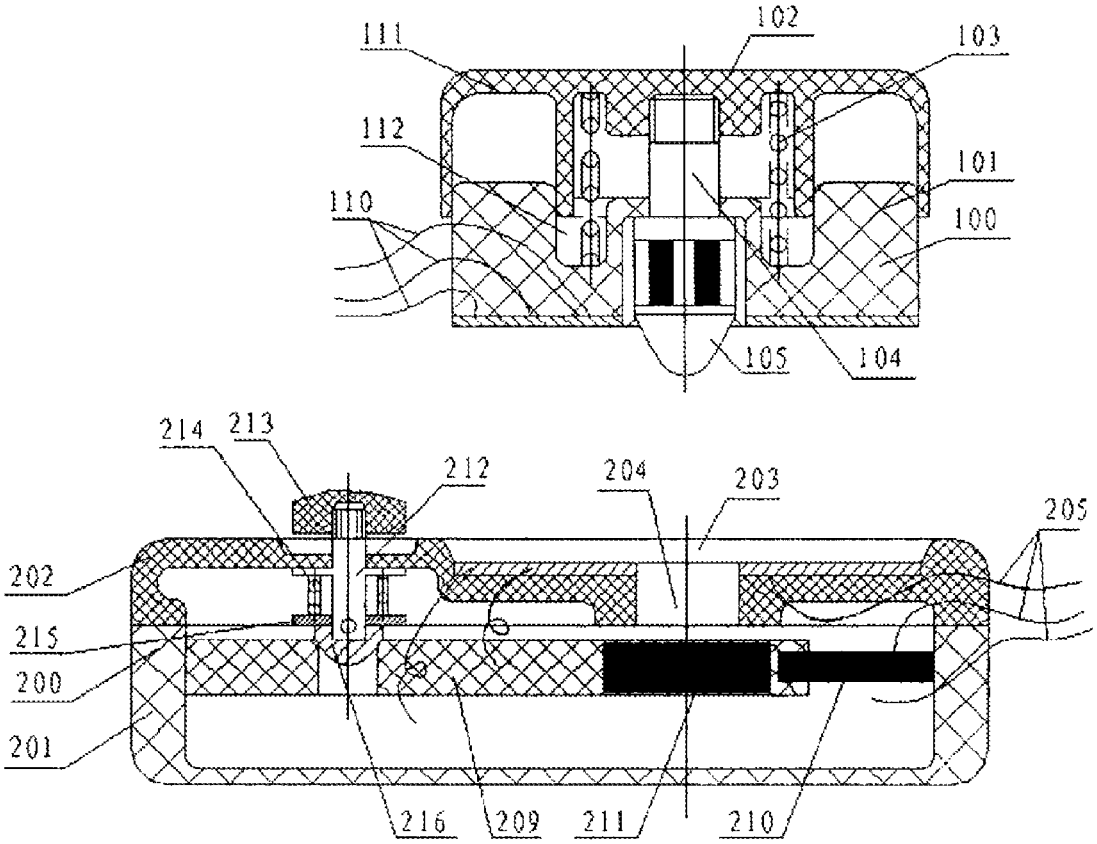
FIG. 10 is another structural diagram of the mutually matching plug and socket.
Figure 11:
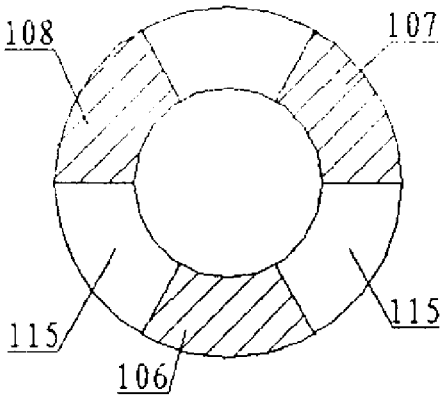
FIG. 11 is a structural diagram of distribution of the electrode presented in FIG. 10.

As shown in FIG. 10 and FIG. 11, the example is similar to example 2, and the difference lies in that the plug contact pieces 1 are arranged on the bottom surface of the lower plug cover 101. However, the plug contact pieces 1 are not arranged to be concentric ring with a plurality of circles on the bottom surface of the lower plug cover 101, but a plurality of plug contact pieces 1 are uniformly arranged on the same circular ring, so that the plug contact pieces 1 form a fan-shaped structure. On the same circular ring, the gap between two adjacent plug pieces 1 is also a fan-shaped structure, that is, a fan-shaped convex seat 115 with area identical with that of the plug contact piece 1 is formed. When three wires are used, three plug contact pieces 1 are uniformly arranged on the same circumferential ring with the lower plug cover 101 as the center. Two adjacent plug contact pieces 1 are separated by the convex seat 115 with area identical with that of the plug contact piece 1, and the center of the circumferential ring is a through hole for the clip shaft 104 to stretch out and retract. Similarly, on the inner bottom of the socket recess 203, socket contact pieces 2 are uniformly arranged on the same circumferential ring with the socket recess 203 as the center. The socket contact pieces 2 are identical with the plug contact pieces 1 in terms of number, shape and structure. When the plug 100 and the socket 200 rotate relatively, the socket contact pieces 2 and the plug contact pieces 1 can match with each other to transmit power. When the socket contact pieces 2 are aligned with the convex seat 115 on the plug 100, power cannot be supplied, which avoids safety accidents. Certainly, in order to avoid relative rotation between the plug and the socket, the convex seats 115 on the plug 100 are aligned. A limit block can be arranged on the side wall of the socket recess 203, which can limit the further turning angle of the plug 100, thus avoiding sudden power failure during use of the plug and the socket.

Example 4

Figure 9:
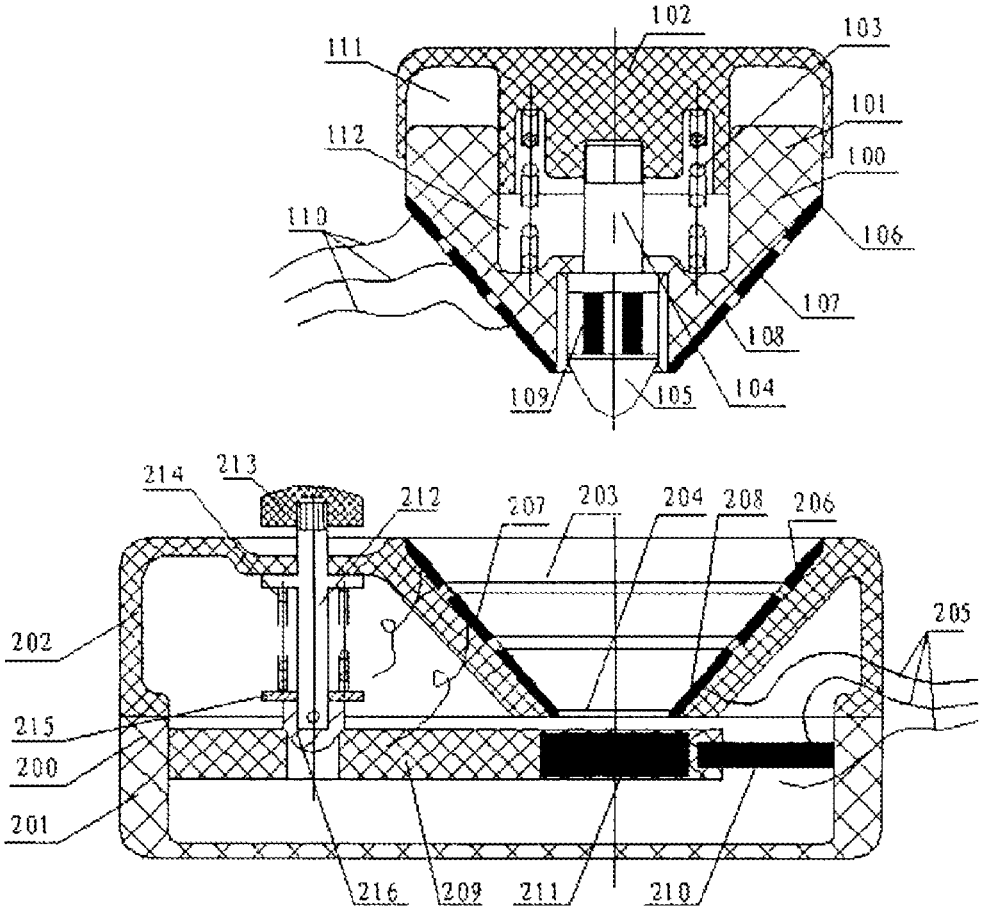
FIG. 9 is another structural diagram of the mutually matching plug and socket.

As shown in FIG. 9, the example is similar to the example 1 and the example 2, and the difference lies in that the lower part of the lower plug cover 101 is an inverted cone structure. A through hole for the clip shaft 104 to stretch out and retract is located at the bottom surface of the cone structure. The plug contact pieces 1 are obliquely arranged on the conical surface of the lower plug cover 101, and the oblique direction is identical with that of the conical surface of the lower plug cover 101. When three-wire power transmission is used, three plug contact pieces 1 form a concentric ring structure with the lower plug cover 101 as the center, and are distributed from top to bottom in the vertical direction. The first plug contact piece 108 is located at the innermost circle of the concentric ring, i.e. the bottommost layer in the vertical direction; the third plug contact piece 106 is located at the outermost circle of the concentric ring, i.e. the topmost layer in the vertical direction; and the second plug contact piece 107 is located at the middle circle of the concentric ring, i.e. the middle layer in the vertical direction. Similarly, the socket recess 203 is an inverted cone recess, so that the lower side wall of the lower plug cover 101 can fit with the side wall of the socket recess 203. The bottom of the socket recess 203 is a socket through hole 204, which is convenient for the clip shaft 104 to pass through the socket recess 203. The socket contact pieces 2 are arranged on the side wall of the socket recess 203, i.e. oblique conical surface. The socket contact pieces 2 are of concentric ring structure with the socket recess 203 as the center. The socket contact pieces 2 are identical with the plug contact pieces 1 in terms of number, shape and structure. When three-wire power transmission is used, three concentric rings are formed, and a structure composed of upper, middle and lower layers is formed in the vertical direction. The first socket contact piece 208 is located at the innermost side of the concentric ring, i.e. the bottommost layer in the vertical direction; the third socket contact piece 206 is located at the outermost side of the concentric ring, i.e. the topmost layer in the vertical direction; and the second socket contact piece 207 is located between the first socket contact piece 208 and the third socket contact piece 206, i.e. the middle layer in the vertical direction. When the plug 100 is inserted into the socket 200, three plug contact pieces 1 can fit with three socket contact pieces 2 respectively for power transmission.

According to the four examples, it can be known that the invention mainly changes the contact means of contact pieces. Contact pieces are in plane contact, therefore, the contact area is increased, the current transmission capacity is increased, the contact is permanently reliable, and the more frequent the plug and the socket are used, the more reliable the contact is in case of the same volume of the plug and the socket. A contact electrode is made to be a circular structure, so that the plug can rotate at any angle on the socket at convenience of use, without causing arbitrary distortion to wires, improving application performance.

According to the examples, it can be hereby known that the contact pieces are mainly arranged between the plug 100 and the socket 200, that is, the plug contact pieces 1 are arranged on the contact surface of the plug 100, and the socket contact pieces 2 are arranged on the contact surface of the socket 200. Therefore, the contact surface between the plug 100 and the socket 200 can be of a plurality of structures. For example, the contact surface between the lower part of the plug 100 and the socket recess 300 on the socket 200 can be arc, rectangular, trapezoidal, etc., so that the lower part of the plug 100 can be inserted into the socket recess 300, and the contact pieces can form surface contact at the connection between the plug 100 and the socket 200. The contact pieces can be of multiple structural shapes. In the examples, plane concentric ring structures are used. Certainly, the contact pieces can be made to be other non-plane structures, e.g. a plurality of concentric ring structures with cross section in arc shape, trapezoidal shape, V shape, U shape, etc. Of course, such non-circular structures as elliptical ring, trapezoidal ring and rectangular ring can be also used. In the examples, a convex part is arranged on the plug 100, and a concave part is arranged on the socket 200. Certainly, the plug 100 can be also made into a concave part, and the socket 200 can be also made into a convex part according to the actual need. In the examples, the clip shaft meeting the shaft head clamp block 211 is the fixing mechanism of the plug 100 and the socket 200, and limits the plug 100 in the socket 200. Certainly, according to the actual need, buckle, thread, inverted buckle, etc. can be also used to fix the plug 100 and the socket 200 relatively. The embodiments and examples can be exchanged arbitrarily or used together as long as actual need is met.

Example 5

Figure 12:
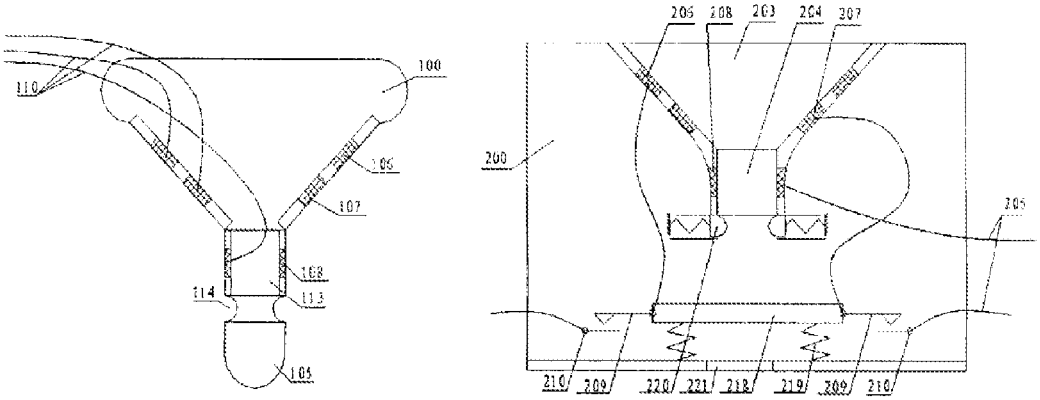
FIG. 12 is another structural diagram of the mutually matching plug and socket.

For the plug of the invention shown in FIG. 12, the plug body is of an inverted cone structure, and a plug nose 113 is arranged at the bottom center of the plug body. The plug nose 113 is cylindrical so that the half section of the entire plug 100 is of the "Y" shaped structure. A plug contact piece 1 is arranged on the lower surface of the plug 100 (i.e. the conical surface of the cone) and on the circumferential wall of the cylindrical plug nose 113 separately. When the plug is subject to two-wire energization, a plug contact piece 1 is arranged on the conical surface, and the other plug contact piece 1 is arranged on the circumferential wall of the cylindrical plug nose 113; when the plug is subject to three-wire energization, a plug contact piece 1 can be arranged on the lower conical surface of the plug 100, and two plug contact pieces 1 are arranged on the circumferential wall of the cylindrical plug nose 113, or two plug contact pieces 1 are arranged on the lower conical surface of the plug 100, and a plug contact piece 1 is arranged on the circumferential wall of the cylindrical plug nose 113; and when the three-wire energization is used in the example, two plug contact pieces 1 arranged on the lower conical surface of the plug 100 are separately a third plug contact piece 106 and a second plug contact piece 107 in a concentric ring structure, wherein the third plug contact piece 106 is located in the outer ring (i.e. located above in the vertical direction) and the second plug contact piece 107 is located in the inner ring (i.e. located below in the vertical direction). A plug contact piece 1 is arranged on the circumferential wall of the cylindrical plug nose 113, that is, a first plug contact piece 108 is wrapped on the circumferential surface of the plug nose 113. The first plug contact piece 108, the second plug contact piece 107 and the third plug contact piece 106 are connected with an electric appliance by plug wires 110 separately; when the plug is subject to four-wire or multi-wire energization, the number of the plug contact pieces arranged on the lower conical surface of the plug 100 or the circumferential wall of the cylindrical plug nose 113 can be determined according to the actual needs. The lower plug nose 113 with the plug contact piece 1 is provided with an annular groove 114, and the annular groove 114 fits with a spring block 220 to prevent the plug 100 from falling off; and the annular groove 114 is located on the circumferential wall centered by the center of the plug nose 113, and the tip of the plug nose 113 is a ball-shaped or conical shaft head 105 to facilitate guiding the plug nose 113 to be inserted into the socket 200.

For the socket of the invention, a socket recess 203 is arranged at the top of a socket 200, and a socket through hole 204 is arranged at the inner bottom center of the socket recess 203. The socket recess 203 is an inverted cone groove and can fit the lower cone surface of the plug 100, and the socket through hole 204 is a cylindrical through hole; a socket contact piece 2 is arranged on the inner side wall of the cone socket recess 203 and on the inner side wall of the socket through hole 204 separately. When the socket 200 is subject to two-wire energization, two socket contact pieces 2 can be arranged on the inner side wall of the socket recess 203 and the inner side wall of the socket through hole 204 respectively; when the socket 200 is subject to three-wire energization, two socket contact pieces 2 can be arranged on the inner side wall of the socket recess 203, and a socket contact piece 2 is arranged on the inner side wall of the socket through hole 204, or a socket contact piece 2 is arranged on the inner side wall of the socket recess 203 and two socket contact pieces 2 are arranged on the inner side wall of the socket through hole 204 according to the actual needs. In the example, the three-wire energization is adopted and two socket contact pieces 2 (i.e. a third socket contact piece 206 and a second socket contact piece 207) are arranged on the inner side wall of the socket recess 203 in the concentric ring. The third socket contact piece 206 is located in the outer ring (located above in the vertical direction) and the second socket contact piece 207 is located in the inner ring (located below in the vertical direction). A first socket contact piece 208 is arranged on the inner side wall of the socket through hole 204; when the socket 200 is subject to four-wire or multi-wire energization, the number of the socket contact pieces on the inner side wall of the socket recess 203 of the socket 200 or on the circumferential wall of the socket through hole 204 can be determined according to the actual needs. A spring block 220 is arranged below the first socket contact piece 208 on the inner side wall of the socket through hole 204, and exposes the socket through hole 204 by the elastic force of the spring, the spring block 220 can fit with the annular groove 114 on the plug nose 113. An elastic sheet 218 is arranged below the socket through hole 204 and an elastic sheet spring 219 is arranged below the elastic sheet 218 which is connected to the inner bottom of the socket 200 through the elastic sheet spring 219. The elastic sheet spring 219 gives the elastic sheet 218 upward elastic force. Power switch moving contacts 209 are arranged at the ends of the elastic sheet 218 and power switch fixed contacts 210 are arranged below the power switch moving contacts 209, the power switch fixed contacts 210 are fixed on the socket 200 and connected to the power supply by socket wires 205, and the power switch fixed contacts 210 are connected with the socket contact pieces 2 through the socket wires 205. For the socket 200 in the example, in case of three-wire energization, two socket contact pieces 2 in the socket 200 are connected with the power switch fixed contacts 210 through the socket wires 205, and another socket contact piece 2 is directly connected to the power supply through the socket wires 205. The power switch moving contacts 209 and the power switch fixed contacts 210 are normally open, so that one can control the contact between the power switch moving contacts 209 and the power switch fixed contacts 210 to control the energization of the socket for energization protection. A drain hole 221 is arranged at the inner bottom of the socket 200 to drain the water out of the socket 200. In addition, the power switch moving contacts 209 can be made of bimetal sheets 300, namely bimetal sheets which can be energized and comprise a first metal sheet 301 and a second metal sheet 302. The bimetal sheets are made of two materials with different coefficients of thermal expansion separately.

When the bimetal sheets are heated and deformed, amount of deformation thereof varies because of the different coefficients of thermal expansion. The principle is designed to the socket in the invention. When the current through the power switch moving contacts 209 is too high and exceeds the expected amperage, the power switch moving contacts 209 are heated to a certain extent and then deformed, the lower metal sheet in the bimetal sheets 300 has larger expansion and deformation than the upper metal sheet to realize the overload protection by disconnecting the power switch moving contacts 209 from the power switch fixed contacts 210, thus effectively avoiding burnout of the socket and a fire during the overcurrent transmission.

When the plug and socket in the example are used, the plug 100 is aligned with the socket recess 203 on the socket 200 and the plug nose 113 is inserted into the socket through hole 204 so that the plug contact piece 1 on the lower surface of the plug 100 fits the socket contact piece 2 at the inner bottom of the socket recess 203. When the shaft head 105 of the plug nose 113 passes through two spring blocks 220 and continues moving downwards, the two spring blocks 220 compress the spring above. When the plug nose 113 continues moving downwards and the spring blocks 220 are aligned with the annular grooves 114, the spring blocks 220 enter into the annular grooves 114 under the action of the spring and clamp the plug nose 113 to prevent the plug 100 from falling out of the socket 200; when the plug nose 113 is moving downwards, the tip of the plug nose 113 contacts the elastic sheet 218 firstly and applies the force to the elastic sheet 218 so that the elastic sheet 218 moves downwards to compress the elastic sheet spring 219, the power switch moving contacts 209 at the tips of the elastic sheet 218 are connected with the power switch fixed contacts 210 to energize the socket 200. When the plug 100 is unplugged out of the socket 200, the elastic sheet 218 is restored to the original position thereof under the action of the elastic sheet spring 219 and the power switch moving contacts 209 are disconnected from the power switch fixed contacts 210 to keep normally on. Therefore, when the socket 200 is not used, the socket contact pieces 2 in the socket 200 are electrically neutral. When your hands can touch a contact electrode (i.e. a socket contact piece 2), the plug and socket must be deenergized and can be energized only when your hands are unable to touch a contact electrode for safe use. Even through a metal is inserted into a socket contact piece 2 in the socket, the short circuit or an electric shock will not occur; in addition, the socket is provided with an overcurrent protection mechanism for the overcurrent protection to effectively avoid burnout of the socket and a fire during the overcurrent transmission.

Example 6

Figure 13:
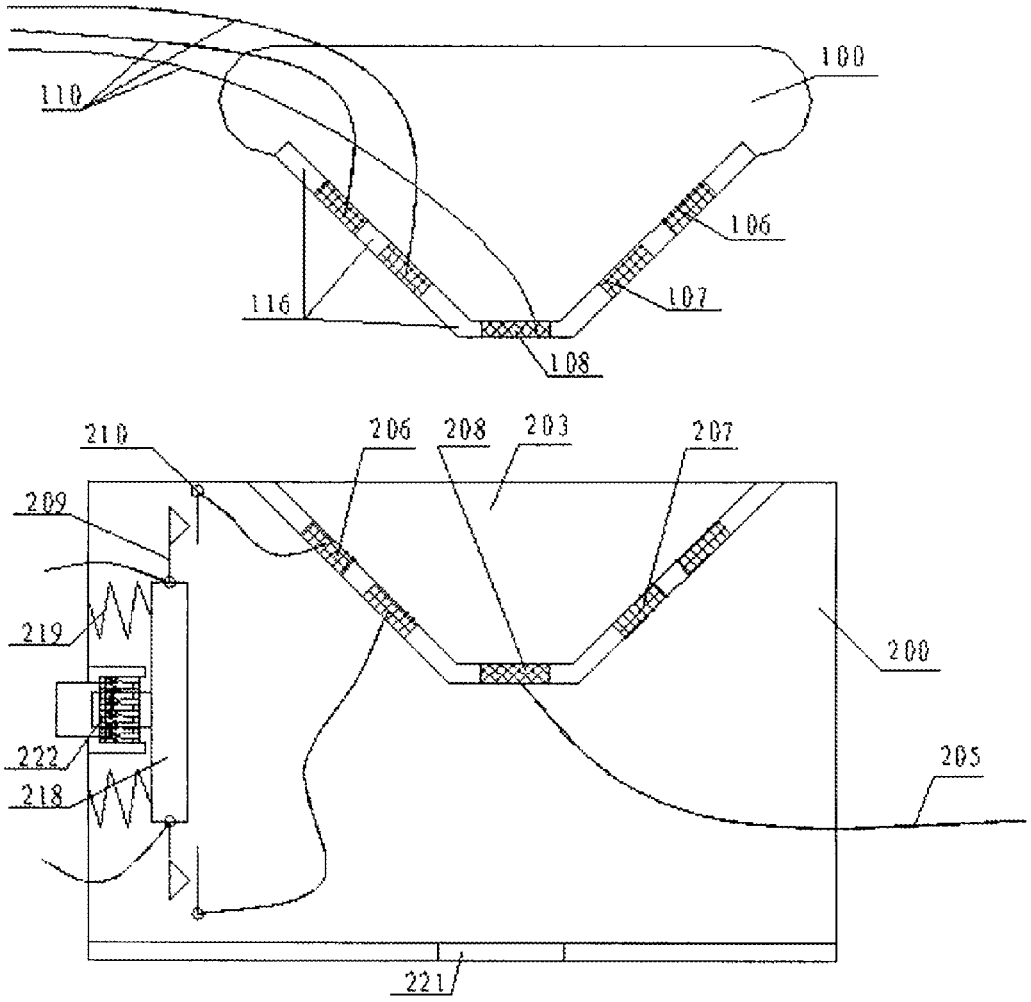
FIG. 13 is another structural diagram of the mutually matching plug and socket.

For the plug of the invention shown in FIG. 13, its bottom is of an inverted cone structure. A plug contact piece 1 is arranged on the lower surface of the plug 100 in a concentric ring structure and around the plug 100. The plug contact piece 1 can be arranged on the conical surface of the cone or on the cone according to the needs. In case of two-wire energization, a plug contact piece 1 is arranged on the conical surface and on the cone surface (i.e. the lower undersurface of the plug 100) separately. In case of three-wire energization, a first plug contact piece 108 can be arranged on the cone surface and a third plug contact piece 106 and a second plug contact piece 107 are arranged on the conical surface in the concentric circle structure with the same arrangement method as the above example. In addition, a magnet 116 is arranged at the gap among the three plug contact pieces 1 that are connected with an electric appliance through plug wires 110. When four-wire or multi-wire energization is adopted, the arrangement can be done arbitrarily according to the above example.

The socket 200 of the invention is provided with a socket recess 203 at the top. The socket recess 203 is an inverted cone recess. A socket contact piece 2 is arranged on the conical surface of the socket recess 203 and can be arranged at the inner bottom of the socket recess 203 separately. According to the arrangement method of the socket contact pieces 2 in the above example, the two socket contact pieces 2 are arranged in a concentric ring structure and a magnet can be arranged at the gap between the socket contact pieces 2 so that a magnet on the plug 100 and the magnet in the socket recess 203 attract each other to prevent the plug 100 from falling out of the socket 200. As shown in other examples, three socket contact pieces 2 are used in the example, wherein two socket contact pieces 2 are arranged on the conical surface of the socket recess 203 in a concentric ring structure, and one penny-shaped socket contact piece 2 is arranged at the inner bottom center of the socket recess 203. When the plug 100 is inserted into the socket recess 203 of the socket 200, the plug contact pieces 1 can fit the socket contact pieces 2 for electricity transmission. An elastic sheet 218 is connected on the socket 100 by an elastic sheet spring 119. The elastic sheet spring 119 is a compression spring. An elastic sheet spring 219 keeps the elastic force to make the elastic sheet 218 keep against the side or bottom of the socket 200. Two power switch moving contacts 209 are provided at the ends of the elastic sheet 218 and connected with the power supply by socket wires 205 separately. Power switch fixed contacts 210 are arranged near the power switch moving contacts 209 and connected with two socket contact pieces 2 on the socket respectively. A sliding-type push-push switch 111 is arranged on the elastic sheet 218, and in the example it is arranged on the side wall of the socket 200. The sliding push-push switch 111 has the same principle as the compression switch on a compression spring ball-point pen, that is, a cylindrical bump is installed at the center of the elastic sheet 218 and nested in a button key which goes through the socket 200 by a sliding sleeve. The sliding sleeve is fixed on the side wall of the socket 200 and a guide groove is arranged on the inner side wall of the sliding sleeve. Guide teeth are arranged on the outer side wall at the end of the button key, and a tooth profile structure and a supporting guide block are arranged on the end face of the button key. A tooth profile structure that fits with the end face of the button key is arranged on the outer wall of the guide block that is nested in the cylindrical bump. When the plug and socket are required and the plug needs to be inserted into the socket, press the button key to fit the tooth profile structure on the end face of the button key with that on the outer wall of the guide block under the action of the guide groove in the sliding sleeve, move the guide block to apply the force to the cylindrical bump and move the elastic sheet 218 to a direction away from the side wall of the socket 200 so that the power switch moving contacts 209 at the ends of the elastic sheet 218 are close to the power switch fixed contacts 210. When loosening the button key, the elastic sheet 218 is tucked near the side wall of the socket 200 under the action of the elastic sheet spring 219 and the cylindrical bump on the elastic sheet 218 is driven to move. Now the tooth profile structure on the end face of the button key fits with that on the outer wall of the guide block to move the button key. The button key is limited by the side wall of the socket 200 and unable to move and the tooth profile structure on the side of the cylindrical bump is limited by the tooth profile structure on the end face of the button key so that the elastic sheet 218 no longer moves and the power switch moving contacts 209 fit the power switch fixed contacts 210 for energization. When the operator applies the force to the button key again, the button key will push the guide block through the tooth profile structure on the end face and then the guide block push the cylindrical bump on the elastic sheet 218 to make the elastic sheet 218 move. When loosening the button key, the elastic sheet 218 moves to the direction of the side wall of the socket 200 under the action of the elastic sheet spring 219 and a guide key on the outer wall of the cylindrical bump slides in the guide groove to make the elastic sheet 218 restore to the original position so that the power switch moving contacts 209 are disconnected from the power switch fixed contacts 210 for deenergization. Therefore, the electrodes in the socket can be energized or deenergized by the sliding push-push switch 222. When the button key is not pressed, the socket contact pieces 2 in the socket 200 are electrically neutral. When your hands can touch a contact electrode (i.e. a socket contact piece 2), the plug and socket must be deenergized and can be energized only when your hands are unable to touch a contact electrode for safe use. Even through a metal is inserted into a socket contact piece 2 in the socket, the short circuit or an electric shock will not occur; in addition, the socket is provided with an overcurrent protection mechanism such as the bimetal sheets of the power switch moving contacts 209 in the example 5; in addition, according to the principle of losing the magnetic force of a magnet at the curie point, select the curie point of the magnet 116 on the plug 100 according to the actual needs when the socket is designed. When the current in the plug and socket overloads, the fitting position between a plug contact piece 1 on the plug 100 and a socket contact piece 2 on the socket 200 is heated to heat the magnet 116 between the plug contact pieces 1. When the temperature is at the curie point of the magnet 116, the magnet 116 will lose its magnetism so that the plug 100 falls out of the socket 200 to provide the overcurrent protection for the socket 200. With the overcurrent protection, the burnout of the socket and a fire during the overcurrent transmission can be prevented effectively. In addition, a drain hole 221 can be provided at the bottom of the socket 200.

Example 7

Figure 14:
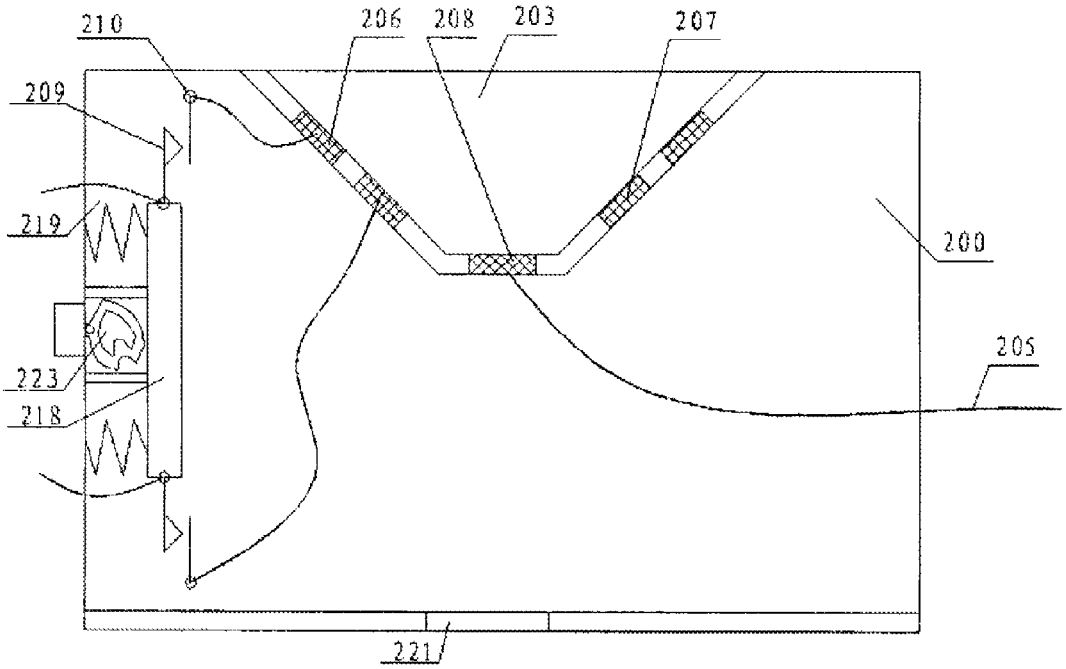
FIG. 14 is another structural diagram of the socket presented in FIG. 13.

As shown in FIG. 14, the socket of the invention is similar to the socket 200 in the example 6 and the differences are as follows: a bistable push-push switch 223 is arranged on the side wall of the socket 200 and connected with the elastic sheet 218. The bistable push-push switch 223 comprises a button key and a rail groove plate, wherein the rail groove plate is installed on the elastic sheet 218 and provided with a rail groove in the inclined heart-shaped structure, and the button key is connected with a sliding block. Springs are connected in four directions of the sliding block so that it is located at the center of the four springs. When pressing the button key, the sliding block can move in the rail groove under the action of the button key so that the elastic sheet 218 is pushed by the rail groove plate and then the power switch moving contacts 209 are connected with the power switch fixed contacts 210 for energization. When loosening the button key, the sliding block slides to the center of the heart-shaped rail groove in the rail groove to keep the elastic sheet 218 still; when continuing pressing the button key, the sliding block continues sliding in the rail groove and returns to the original position, and the elastic sheet 218 is restored to the original position thereof under the action of the spring so that the power switch moving contacts 209 are disconnected from the power switch fixed contacts 210 for deenergization.

According to principles of the examples 6 and 7, a control key can be installed on the side wall of the socket 200 to control the motion of the elastic sheet 218 so that the power switch moving contacts 209 are connected with the power switch fixed contacts 210 for energization and keeping energization. You can continue pressing the control key to make the elastic sheet 218 restore to the original position thereof under the action of the elastic sheet spring 219 so that the power switch moving contacts 209 are disconnected from the power switch fixed contacts 210 for deenergization. The control key is to energize by pressing downwards and to deenergize by continuing pressing downwards. Control keys in other structures can be designed according to the control key for the socket of the invention to ensure the safe use of the socket 200. When the control key is not pressed, the socket contact pieces 2 in the socket 200 are electrically neutral. When your hands can touch a contact electrode (i.e. a socket contact piece 2), the plug and socket must be deenergized and can be energized only when your hands are unable to touch a contact electrode for safe use. Even through a metal is inserted into a socket contact piece 2 in the socket, the short circuit or an electric shock will not occur.

Example 8

Figure 15:
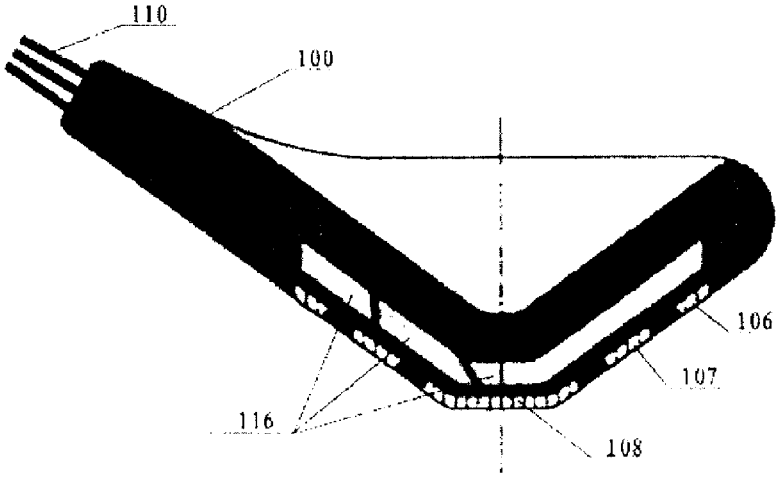
FIG. 15 and FIG. 16 are another two structural diagrams of the mutually matching plug and socket.
Figure 16:
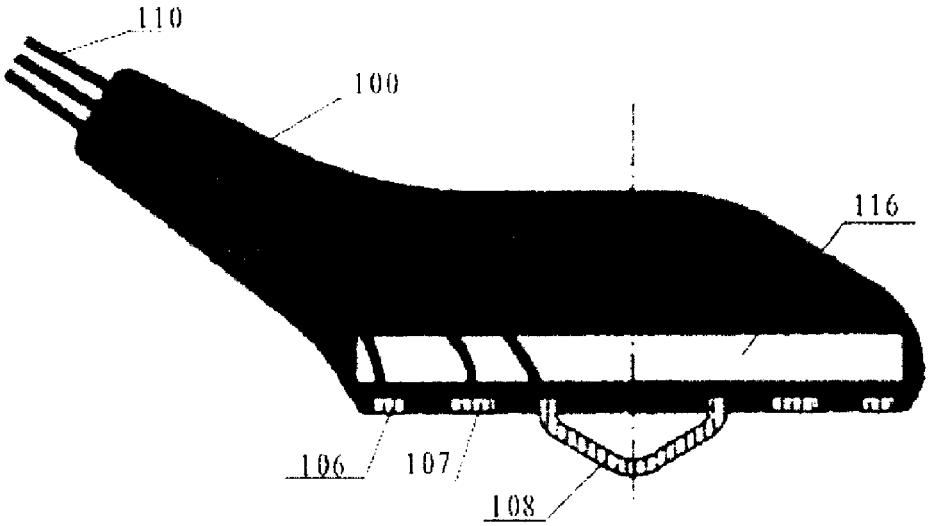

As shown in FIG. 15 and FIG. 16, the plug 100 in the example has the same structure as the plug in the example 6 and the socket 200 has the same arrangement between the socket recess 203 and socket contact pieces 2 as the socket in the example 6. An elastic sheet 218 is provided below a socket recess 203 of the socket 200. The elastic sheet 218 can be made of magnets or ferrous materials and connected to the bottom of the socket 200 by an elastic sheet spring 219 to make the elastic sheet 218 tucked. Power switch moving contacts 209 that fit with the power switch fixed contacts 210 are arranged at two ends of the elastic sheet 218 and connected with the power supply through socket wires 205. When the plug 100 is inserted into the socket recess 203 in the socket 200, the magnet on the plug 100 attracts the elastic sheet 218 to make the elastic sheet 218 move upwards so that the power switch fixed contacts 210 at two ends of the elastic sheet 218 are connected with the power switch fixed contacts 210 for energization. When the current in the plug and socket overloads, the plug contact pieces 1 are heated and the magnet on the plug 100 is also heated. When the temperature is at the curie point, the magnet will lose its magnetism immediately and the elastic sheet 218 is restored to the original position under the action of the elastic sheet spring 219, so that the power switch fixed contacts are disconnected from the power switch moving contacts 209 for deenergization to provide the current overload protection for the plug and socket. When your hands can touch a contact electrode, the plug and socket must be deenergized and can be energized only when your hands are unable to touch a contact electrode for safe use. Even through a metal is inserted into a socket contact piece, the short circuit or an electric shock will not occur; in addition, the socket is provided with an overcurrent protection mechanism for the overcurrent protection to effectively avoid burnout of the socket and a fire during the overcurrent transmission.

Example 9

Figure 17:
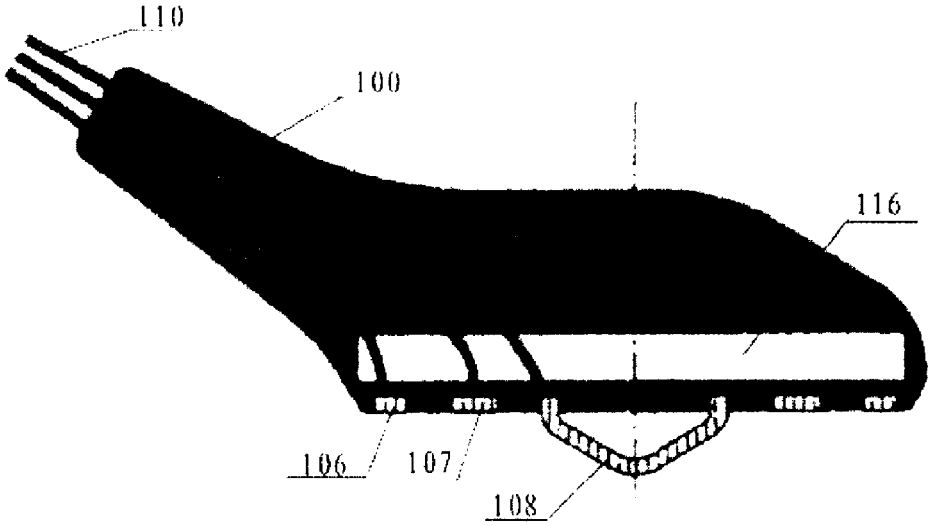
FIG. 17 and FIG. 18 are another two structural diagrams of the mutually matching plug and socket.
Figure 18:
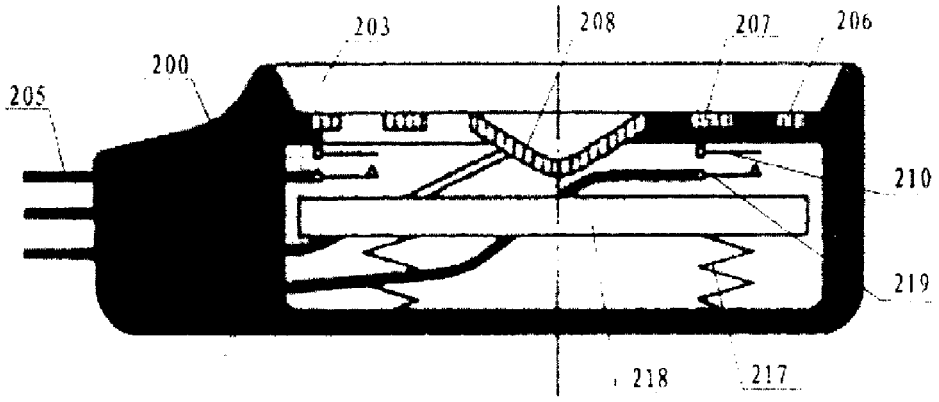

As shown in FIG. 17 and FIG. 18, the example is similar to the example 8 and the difference are as follows: the bottom of the plug 100 is a plane, and three plug contact pieces 1 at the bottom of the plug 100 are a third plug contact piece 106, a second plug contact piece 107 and a first plug contact piece 108 in a concentric ring structure. The third plug contact 106 and the second plug contact piece 107 are flaky rings, and the first plug contact piece 108 in the innermost ring is of a cone structure and its section is a "V"-shaped section; the socket recess 203 on the socket 200 is a flat bottom recess, and the first socket contact piece 208 as the innermost ring in the socket recess 203 has the same cone structure as the first plug contact piece 108.

Example 10

Figure 19:
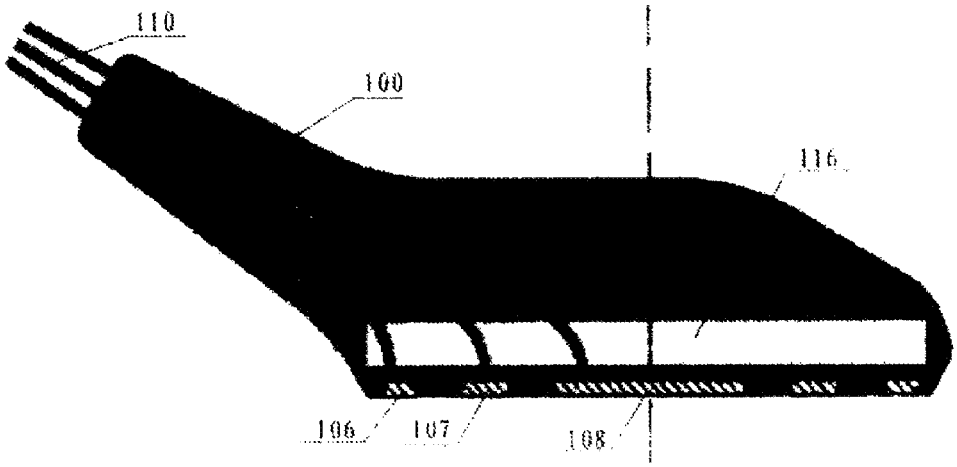
FIG. 19 and FIG. 20 are another two structural diagrams of the mutually matching plug and socket.
Figure 20:
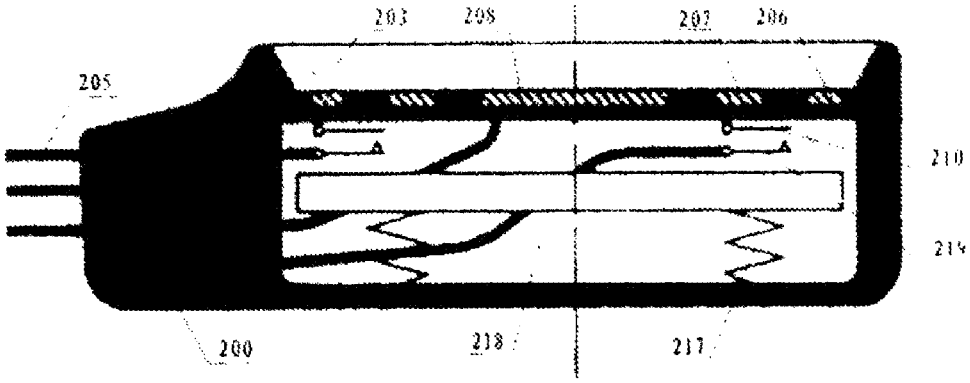
Figure 21:
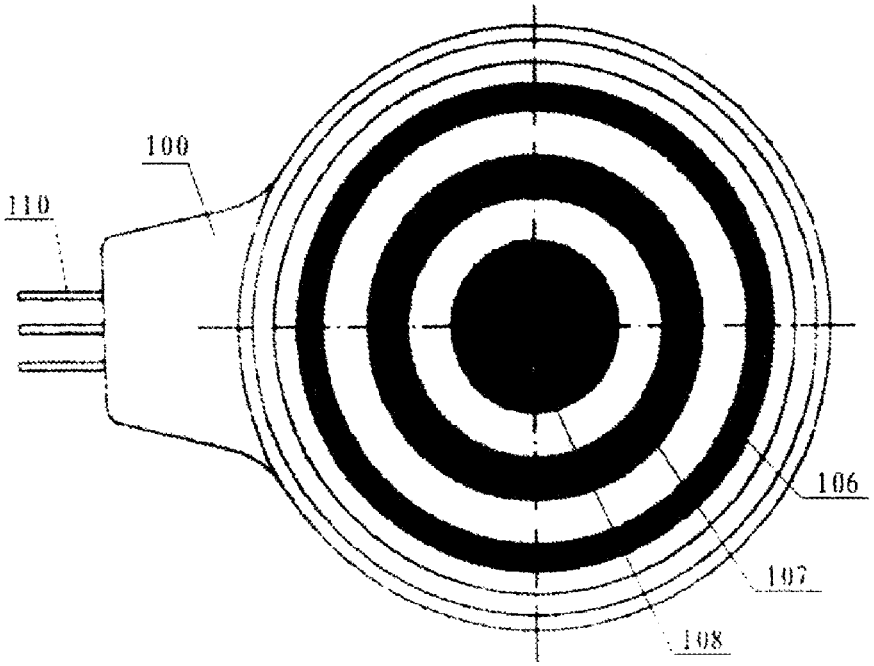
FIG. 21 is an upward view of FIG. 15, FIG. 17 and FIG. 19.

As shown in FIG. 19, FIG. 20 and FIG. 21, the example is similar to the example 8 and example 9 and the difference are as follows: the bottom surface of the plug 100 is a plane, and three plug contact pieces 1 at the bottom surface of the plug 100 comprise a third plug contact piece 106, a second plug contact piece 107 and a first plug contact piece 108 separately which are flaky metal sheets and in a concentric ring structure. The first plug contact piece 108 is located in the innermost ring, the third plug contact piece 106 is located in the outermost ring and the second plug contact piece 107 is between the innermost ring and the outermost ring. In a similar way, the socket recess 203 in the socket 100 is a flat bottom recess and three socket contact pieces 2 are flaky metal sheets in a concentric ring structure.

Example 11

Figure 7:
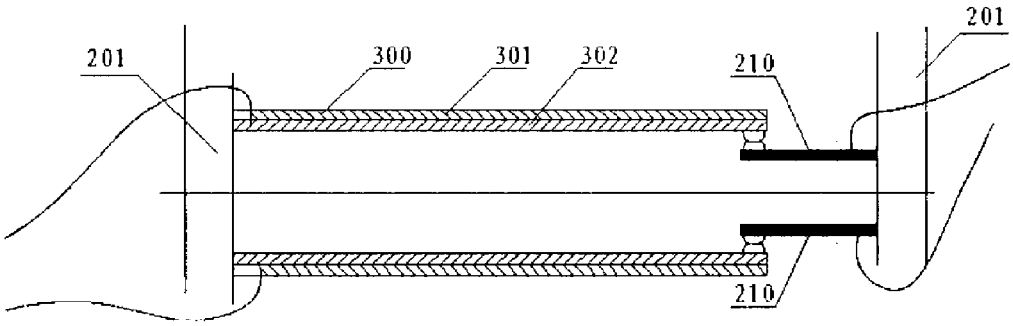
FIG. 7 is another structural diagram of the power switch of the invention in open position.

As shown in FIG. 7, the overcurrent protection mechanism in the plug and the socket of the invention consists of power switch moving contacts 209 made of bimetal sheets 300. The bimetal sheets 300 comprise a first metal sheet 301 and a second metal sheet 302 made of two materials with different coefficients of thermal expansion. When the sheets are deformed due to heating, one has larger deformation than the other metal sheet so that the power switch moving contacts 209 are disconnected from the power switch fixed contacts 210 to deenergize for overcurrent protection.

Example 12

Figure 22:
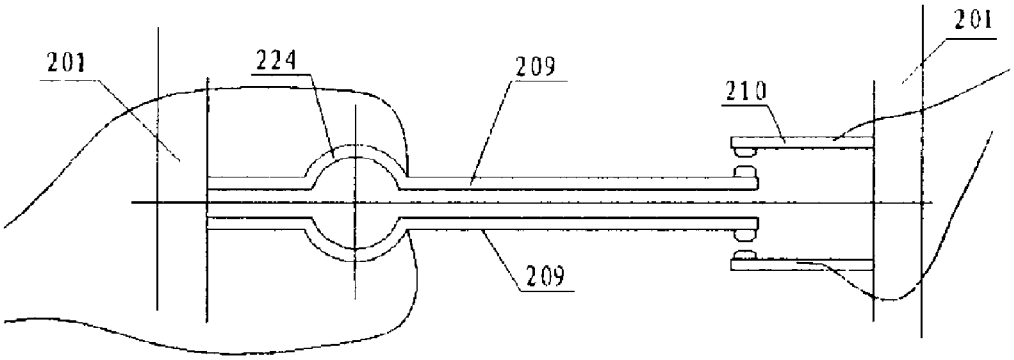
FIG. 22 is another structural diagram of the power switch of the invention in open position.

For the plug and the socket of the invention as shown in FIG. 22, an opening and closing mechanism controlling the connection of power switch moving contacts 209 with power switch fixed contacts 210 during the energization of electrodes can be made of a plastic spring 224. The tail of the plastic spring 224 is a circular sheet that is made of plastic materials with good elasticity and expansibility. The circular sheet is fixed on the socket 200 and power switch moving contacts 209 are connected at two ends of the circular sheet and to socket contact pieces 2 separately. The power switch moving contacts 209 can fit with the power switch fixed contacts 210 relatively. When an expansion shaft head stretches to the circular sheet at the tail of the plastic spring 224, the circular sheet is expanded so that the power switch moving contacts 209 are connected with the power switch fixed contacts 210 for energization. When the expansion shaft head is taken out of the circular sheet, the circular sheet gets back into shape so that the power switch moving contacts 209 are disconnected from the power switch fixed contacts 210 for deenergization. Bimetal sheets can also be used in the power switch moving contacts 209 for overcurrent protection.

The invention is not limited to the embodiments. The invention can be expanded to any new feature or any new combination disclosed in the specification, and steps in any new method or procedure or any new combination disclosed.

The invention claimed is:

1. An assembly of plug and socket in surface contact, comprising a plug (100) and a socket (200) wherein the plug (100) is insertable into the socket (200), characterized in that plug contact pieces (1) connected with plug wires (110) are arranged on the lower surface of the plug (100), socket contact pieces (2) connected with socket wires (205) are arranged on the upper surface of the socket (200); when the plug (100) is inserted into the socket (200), the plug contact pieces (1) meet the socket contact pieces (2) to cause surface contact energization, and wherein the assembly further comprises a locating fixing mechanism, an overcurrent protection mechanism, and a power supply safety switch; wherein the locating fixing mechanism maintains surface contact between the plug contact pieces (1) and the socket contact pieces (2) when the plug (100) and the socket (200) rotate relative to each other, wherein the overcurrent protection mechanism automatically deenergizes the socket (200) when receiving an excessive current; and when the plug (100) is inserted into the socket (200), the power supply safety switch energizes the socket (200), and when the plug (100) is not inserted into the socket (200) or is not inserted in place, the power supply safety switch deenergizes the socket (200).

2. The assembly according to claim 1, characterized in that a socket recess (203) is arranged on the socket (200), the lower part of the plug (100) and the cavity of the socket recess (203) are a boss and a recess with large upper parts and small lower parts which are matched with each other respectively, the plug contact pieces (1) are arranged on the boss surface of the plug (100) and/or the sloping side wall of the boss, and the socket contact pieces (2) are arranged on the inner cone surface and/or the inner sloping side wall of the socket recess (203).

3. The assembly according to claim 2, characterized in that the lower part of the plug (100) and the cavity of the socket recess (203) are inverted cone, inverted cone frustum, inverted stepped truncated cone or inverted stepped cone frustum; the plug contact pieces (1) are uniformly arranged on the lower cone surface of the plug (100) or the lower cone surface and/or the cone of the plug (100) in the form of concentric rings, and the socket contact pieces (2) are uniformly arranged on the lower cone surface of the socket (200) or the inner cone surface and/or inner cone of the socket (200) in the form of concentric rings.

4. The assembly according to claim 1, characterized in that power switch moving contacts (209) and power switch fixed contacts (210) are arranged in the socket (200), the power switch moving contacts (209) are connected onto the socket contact pieces (2) or the socket wires (205), and the power switch fixed contacts (210) are correspondingly connected onto the socket wires (205) or the socket contact pieces (2); the power supply safety switch drives the power switch moving contacts (209) to move under action of a push-and-move key, so that the power supply safety switch is connected with or disconnected from the power switch fixed contacts (210) for energization or deenergization; and the overcurrent protection mechanism disconnects the power switch moving contacts (209) from the power switch fixed contacts (210) for deenergization in case of excessive current in the plug and the socket.

5. The assembly according to claim 4, characterized in that the push-and-move key is set to be an elastic sheet (218), the elastic sheet (218) is connected onto the socket (200) by an elastic sheet spring (219), the power switch moving contacts (209) are arranged on the end of the elastic sheet (218) or in the moving direction of the elastic sheet (218), the power switch fixed contacts (210) are arranged in the moving direction of the power switch moving contacts (209), the elastic sheet (218) drives the power switch moving contacts (209) to move under the action of a control key, so that the power switch moving contacts (209) are connected with or disconnected from the power switch fixed contacts (210) for energization or deenergization; or the push-and-move key is a clip key arranged on the plug (100) and a buckling key arranged on the power switch moving contacts (209), the ends of the power switch moving contacts (209) are moved when the clip key moves in and out of the buckling key, so that the power switch moving contacts (209) are connected with or disconnected from the power switch fixed contacts (210) for energization or deenergization.

6. The assembly according to claim 5, characterized in that the control key is a push-push switch connected onto the elastic sheet (218) and passing through the side wall of the socket (200); or the control key is a magnet (116) arranged in the plug (100), the magnet (116) attracts the elastic sheet (218) under the socket recess (203); or the control key is a plug nose (113) arranged on the bottom of the plug (100), and the tip of the plug nose (113) passes through a socket through hole (204) on the inner bottom of the socket recess (203) and props against the elastic sheet (218) under the socket through hole (204).

7. The assembly according to claim 4, characterized in that the overcurrent protection mechanism mainly consists of the power switch moving contacts (209) and/or the power switch fixed contacts (210) made of bimetal sheets (300), the bimetal sheets (300) comprise a first metal sheet (301) and a second metal sheet (302) with different coefficients of thermal expansion, the expansion number of one metal sheet is more than that of the other metal sheet in case of thermal deformation of the bimetal sheets (300), so that the power switch moving contacts (209) are disconnected from the power switch fixed contacts (210) for deenergization; or the overcurrent protection mechanism mainly consists of the magnet (116) arranged in the plug (100) and/or socket (200), the magnet (116) loses its magnetic force when the current in the plug and the socket is too high and the temperature of the heat transferred to the magnet (116) reaches the curie point; the elastic sheet (218) under the socket recess (203) is restored to the original position thereof under the action of the elastic sheet spring (219), so that the power switch moving contacts (209) are disconnected from the power switch fixed contacts (210) for deenergization.

8. The assembly according to claim 1, characterized in that the locating fixing mechanism consists of the magnet (116) arranged in the plug (100) and/or the socket (200) so that the plug (100) and the socket (200) are mutually attracted and are configured to relatively rotate without disconnection; or the locating fixing mechanism consists of the clip key arranged on the plug (100) or the socket (200) and the buckling key correspondingly arranged on the socket (200) or the plug (100), the clip key is inserted into the buckling key so that the plug (100) and the socket (200) relatively rotate without disconnection; or the locating fixing mechanism is formed by inserting the plug (100) into the socket (200) or inserting the plug (100) out of the socket (200) and relatively rotating the plug and the socket.

9. The assembly according to claim 5, characterized in that the clip key is a telescopic and movable clip shaft (104) arranged on the plug (100), the buckling key is a clamping mechanism arranged under the socket through hole (204) on the inner bottom of the socket recess (203), the clamping mechanism is composed of shaft head clamp blocks (211) on the power switch moving contacts (209), the shaft head clamp blocks (211) on two power switch moving contacts (209) mutually clamp the tip of the clip shaft (104), the power switch moving contacts (209) are set to be elastic metal sheets or provided with return springs, release clamp blocks (217) are arranged on the power switch moving contacts (209), a telescopic and movable release pin shaft (212) passing through the socket (200) is arranged above the release clamp blocks (217); when the tip of the release pin shaft (212) is inserted between two release clamp blocks (217), ends of the two power switch moving contacts (209) move, so that the power switch moving contacts (209) are disconnected from the power switch fixed contacts (210) for deenergization, and two shaft head clamp blocks (211) release clamping of the tip of the clip shaft (104).

* * * * *